US010683132B2

(12) United States Patent
Purkey et al.

(10) Patent No.: US 10,683,132 B2
(45) Date of Patent: Jun. 16, 2020

(54) CONVERTIBLE SHIPPING CONTAINER AND METHOD OF DISPLAYING A PRODUCT

(71) Applicant: Sargento Foods Inc., Plymouth, WI (US)

(72) Inventors: Todd Purkey, Elkhart Lake, WI (US); Jeff Karp, Plymouth, WI (US)

(73) Assignee: Sargento Foods Inc., Plymouth, WI (US)

( * ) Notice: Subject to any disclaimer, the term of this patent is extended or adjusted under 35 U.S.C. 154(b) by 11 days.

(21) Appl. No.: 15/663,480

(22) Filed: Jul. 28, 2017

(65) Prior Publication Data

US 2018/0029747 A1 Feb. 1, 2018

Related U.S. Application Data

(60) Provisional application No. 62/369,598, filed on Aug. 1, 2016.

(51) Int. Cl.

| | |
|---|---|
| ***B65D 5/72*** | (2006.01) |
| ***B65D 5/70*** | (2006.01) |
| ***B65D 5/42*** | (2006.01) |
| ***B65D 5/54*** | (2006.01) |
| ***B65B 43/10*** | (2006.01) |
| ***B65D 5/32*** | (2006.01) |
| ***B65D 5/02*** | (2006.01) |

(52) U.S. Cl.

CPC ..... *B65D 5/725* (2013.01); *B65B 43/10* (2013.01); *B65D 5/0227* (2013.01); *B65D 5/322* (2013.01); *B65D 5/4266* (2013.01); *B65D 5/541* (2013.01); *B65D 5/542* (2013.01); *B65D 5/701* (2013.01)

(58) Field of Classification Search

CPC ..... B65D 5/725; B65D 5/322; B65D 5/4266; B65D 5/541; B65D 5/701; B65D 5/5445; B65D 2571/00574; B65B 43/10

USPC ..... 229/100, 164, 242, 103, 235, 166, 241; 206/774, 736, 746, 738, 747, 750

See application file for complete search history.

(56) References Cited

U.S. PATENT DOCUMENTS

| | | | | |
|---|---|---|---|---|
| 3,653,495 | A | 4/1972 | Gray | |
| 3,884,348 | A | 5/1975 | Ross | |
| 4,000,811 | A * | 1/1977 | Hardison | B65D 5/48048 206/503 |
| 4,553,666 | A | 11/1985 | Gullikson | |
| 5,582,345 | A | 12/1996 | Lankhuijzen | |
| 5,657,872 | A | 8/1997 | Leftwich et al. | |
| 5,881,884 | A * | 3/1999 | Podosek | B65D 5/5445 206/736 |

(Continued)

*Primary Examiner* — Christopher R Demeree

(74) *Attorney, Agent, or Firm* — Boyle Fredrickson S.C.

(57) ABSTRACT

A shipping container convertible into a display container. The shipping container includes a case generally defining a plurality of sides, the case being divisible along tear lines into a display portion and a tear portion. The display portion defines at least one of the plurality of sides, and the tear portion at least partially defines at least two of the plurality of sides. A tear support piece is couplable to the tear portion and adapted to be couplable to the at least two of the plurality of sides. The tear support piece is adapted to add rigidity to the tear portion to facilitate divisibility of the tear portion and the display portion. The display portion is convertible into the display container by removal of the tear portion and the tear support piece.

8 Claims, 15 Drawing Sheets

(56) References Cited

U.S. PATENT DOCUMENTS

| | | | | |
|---|---|---|---|---|
| 5,887,717 | A | 3/1999 | Anderson et al. | |
| 5,927,498 | A | 7/1999 | Saam | |
| 6,129,211 | A | 10/2000 | Prakken et al. | |
| 6,168,027 | B1 | 1/2001 | Esser | |
| 6,464,131 | B1 | 10/2002 | Blazevich | |
| 6,478,159 | B1 | 11/2002 | Taylor et al. | |
| 6,510,982 | B2 | 1/2003 | White et al. | |
| 6,588,594 | B2 | 7/2003 | Anderson et al. | |
| 6,729,475 | B2 * | 5/2004 | Yuhas | B65D 5/52 206/746 |
| 6,755,306 | B2 | 6/2004 | Maus | |
| 6,974,033 | B2 | 12/2005 | McLeod et al. | |
| 7,021,468 | B2 | 4/2006 | Cargile, Jr. | |
| 7,370,761 | B2 | 5/2008 | Anderson et al. | |
| 7,451,878 | B2 | 11/2008 | Rochefort et al. | |
| 7,604,114 | B2 | 10/2009 | Gessler | |
| 7,988,034 | B2 | 8/2011 | Pezzoli | |
| 8,342,335 | B2 | 1/2013 | Couture | |
| 8,376,141 | B2 | 2/2013 | Couture | |
| 8,430,296 | B2 * | 4/2013 | Mathieu | B65D 5/68 229/125.19 |
| 8,474,688 | B2 | 7/2013 | Cameron | |
| 8,752,708 | B2 | 6/2014 | Keefe | |
| 8,789,703 | B2 | 7/2014 | Couture et al. | |
| 9,187,207 | B2 | 11/2015 | Gessler, Jr. et al. | |
| 9,266,632 | B1 | 2/2016 | Anderson et al. | |
| 9,382,041 | B2 | 7/2016 | Couture | |
| 9,555,919 | B2 | 1/2017 | Gessler, Jr. et al. | |
| 9,809,349 | B2 | 11/2017 | Gessler, Jr. et al. | |
| 2003/0150747 | A1 | 8/2003 | Maus | |
| 2004/0222127 | A1 | 11/2004 | McLeod et al. | |
| 2005/0139502 | A1 | 6/2005 | Anderson et al. | |
| 2005/0184139 | A1 | 8/2005 | Gasior | |
| 2006/0261140 | A1 * | 11/2006 | Holley, Jr. | B65D 71/36 229/242 |
| 2007/0074997 | A1 | 4/2007 | Ford et al. | |
| 2010/0276333 | A1 * | 11/2010 | Couture | B65D 5/5445 206/774 |
| 2011/0259947 | A1 | 10/2011 | Brittain | |
| 2011/0284621 | A1 * | 11/2011 | Couture | B65D 5/5445 229/103 |
| 2013/0105355 | A1 * | 5/2013 | Keefe | B65D 5/5445 206/736 |
| 2016/0304237 | A1 | 10/2016 | Couture | |
| 2017/0021961 | A1 | 1/2017 | Humphrey et al. | |
| 2017/0174389 | A1 | 6/2017 | Keefe, Jr. | |
| 2017/0361974 | A1 * | 12/2017 | Capistrant | B65D 5/5445 |
| 2018/0118406 | A1 * | 5/2018 | Weiss | B65D 5/5445 |

* cited by examiner

CONVERTIBLE SHIPPING CONTAINER AND METHOD OF DISPLAYING A PRODUCT

CROSS REFERENCE TO RELATED APPLICATIONS

This application claims priority to U.S. Provisional Patent Application No. 62/369,598 filed on Aug. 1, 2016, the contents of which are incorporated by reference herein.

BACKGROUND

The present disclosure relates to a shipping container or carton that is convertible into a display container or carton. For example, such containers may be used to ship a product to a retailer and then to display the product to consumers.

SUMMARY

In one construction, the disclosure provides a shipping container convertible to a display container. The shipping container includes a case generally defining a plurality of sides, the case being divisible along tear lines into a display portion and a tear portion. The display portion defines at least one of the plurality of sides. The tear portion at least partially defines at least two of the plurality of sides, and the at least two of the plurality of sides of the tear portion are adjacent. A tear support piece is couplable to the tear portion and adapted to be couplable to the at least two of the plurality of sides that are adjacent. The tear support piece includes a fold line defining no more than two sections, each section couplable to one of the at least two of the plurality of sides. The tear portion is configured to provide a first layer of material and the tear support piece is configured to provide a second layer of material increasing a thickness of the shipping container to add rigidity to the tear portion for facilitating divisibility of the tear portion and the display portion, the thickness defined between an interior of the shipping container and an exterior of the shipping container. The display portion is convertible into the display container by removal of the tear portion and the tear support piece.

In another construction the disclosure provides a shipping container convertible to a display container. The shipping container includes a case having a plurality of sections, each section generally defining a side such that the case defines a plurality of sides, the plurality of sides substantially enclosing a chamber on all sides for containing a product package, the case being divisible along tear lines into a display portion and a tear portion. The shipping container also includes no more than one handle disposed proximate the tear lines for facilitating division of the case along the tear lines. The product package is disposed in the case and is elongated in a direction defining an axis of elongation, the product package oriented from a first side towards a second side of the plurality of sides such that the axis of elongation intersects the first and second sides of the case. The display portion includes at least a portion of every one of the plurality of sections on every one of the plurality of sides. The display portion is convertible into the display container by removal of the tear portion using one hand.

In another construction the disclosure provides a shipping container convertible to a display container. The shipping container includes a case generally defining a plurality of sides, the case being divisible along tear lines into a display portion and a tear portion. The display portion defines at least one of the plurality of sides. The tear portion at least partially defines at least two of the plurality of sides, and the at least two of the plurality of sides of the tear portion are adjacent. A tear support piece is couplable to the tear portion and adapted to be couplable to the at least two of the plurality of sides that are adjacent. The tear support piece includes no more than a single fold line defining two sections, each section couplable to one of the at least two of the plurality of sides. The display portion is convertible into the display container by removal of the tear portion and the tear support piece.

In another construction the disclosure provides a shipping container convertible into a display container. The shipping container includes a case generally defining a plurality of sides, the plurality of sides substantially enclosing a chamber on all sides for containing a product, the case being divisible along tear lines into a display portion and a tear portion. A tear support piece is couplable to the tear portion. The tear portion is configured to provide a first layer of material and the tear support piece is configured to provide a second layer of material increasing a thickness of the shipping container, the thickness defined between an interior of the chamber to an exterior of the shipping container. The display portion is convertible into the display container by removal of the tear portion and the tear support piece.

In another construction the disclosure provides a shipping container convertible into a display container. The shipping container includes a case having a plurality of sections, each section generally defining a side such that the case defines a plurality of sides, the plurality of sides substantially enclosing a chamber on all sides for containing a product, the case being divisible along tear lines into a display portion and a tear portion. The display portion is convertible into the display container by removal of the tear portion. The display portion includes at least a portion of every one of the plurality of sections on every one of the plurality of sides. The product includes a plurality of packages arranged side-by-side in no more than a single row.

In another construction the disclosure provides a shipping container convertible into a display container. The shipping container includes a case generally defining a plurality of sides, the case being divisible along tear lines into a display portion and a tear portion. The display portion defines at least one of the plurality of sides, and the tear portion defines at least 30% of at least one but no more than two of the plurality of sides. The shipping container includes no more than one handle disposed proximate the tear lines for facilitating division of the case along the tear lines. The display portion is convertible into the display container by removal of the tear portion using one hand.

In another construction the disclosure provides a shipping container convertible into a display container. The shipping container includes a case generally defining a plurality of sides, the case being divisible along tear lines into a display portion and a tear portion. A product package is disposed in the case, the product package being elongated in a direction defining an axis of elongation, the product package arranged from a bottom side towards a top side of the plurality of sides such that the axis of elongation intersects the top and bottom sides of the case. The display portion is convertible into the display container by removal of the tear portion. The display container includes at least a portion of a first section defining the bottom side and at least a portion of a second section defining the top side.

In another construction the disclosure provides a shipping container convertible into a display container. The shipping container includes a case generally defining a plurality of sides, the case being divisible along tear lines into a display portion and a tear portion. The shipping container also includes a product package disposed in the case, the product package being elongated in a direction defining an axis of elongation, the product package arranged from a bottom side towards a top side of the plurality of sides such that the axis of elongation intersects the top and bottom sides of the case. The display portion is convertible into the display container by removal of the tear portion. The display container includes at least a portion of a first section defining the bottom side and at least a portion of a second section defining the top side.

In yet another construction the disclosure provides a shipping container convertible into a display container. The shipping container includes a case generally defining a plurality of sides, the case being divisible along tear lines into a display portion and a tear portion. The display portion defines at least one of the plurality of sides, and the tear portion at least partially defines at least two of the plurality of sides. A tear support piece is couplable to the tear portion and adapted to be couplable to the at least two of the plurality of sides. The tear support piece is adapted to add rigidity to the tear portion to facilitate divisibility of the tear portion and the display portion. The display portion is convertible into the display container by removal of the tear portion and the tear support piece.

Other aspects of the disclosure will become apparent by consideration of the detailed description and accompanying drawings.

DETAILED DESCRIPTION

Figure 1:
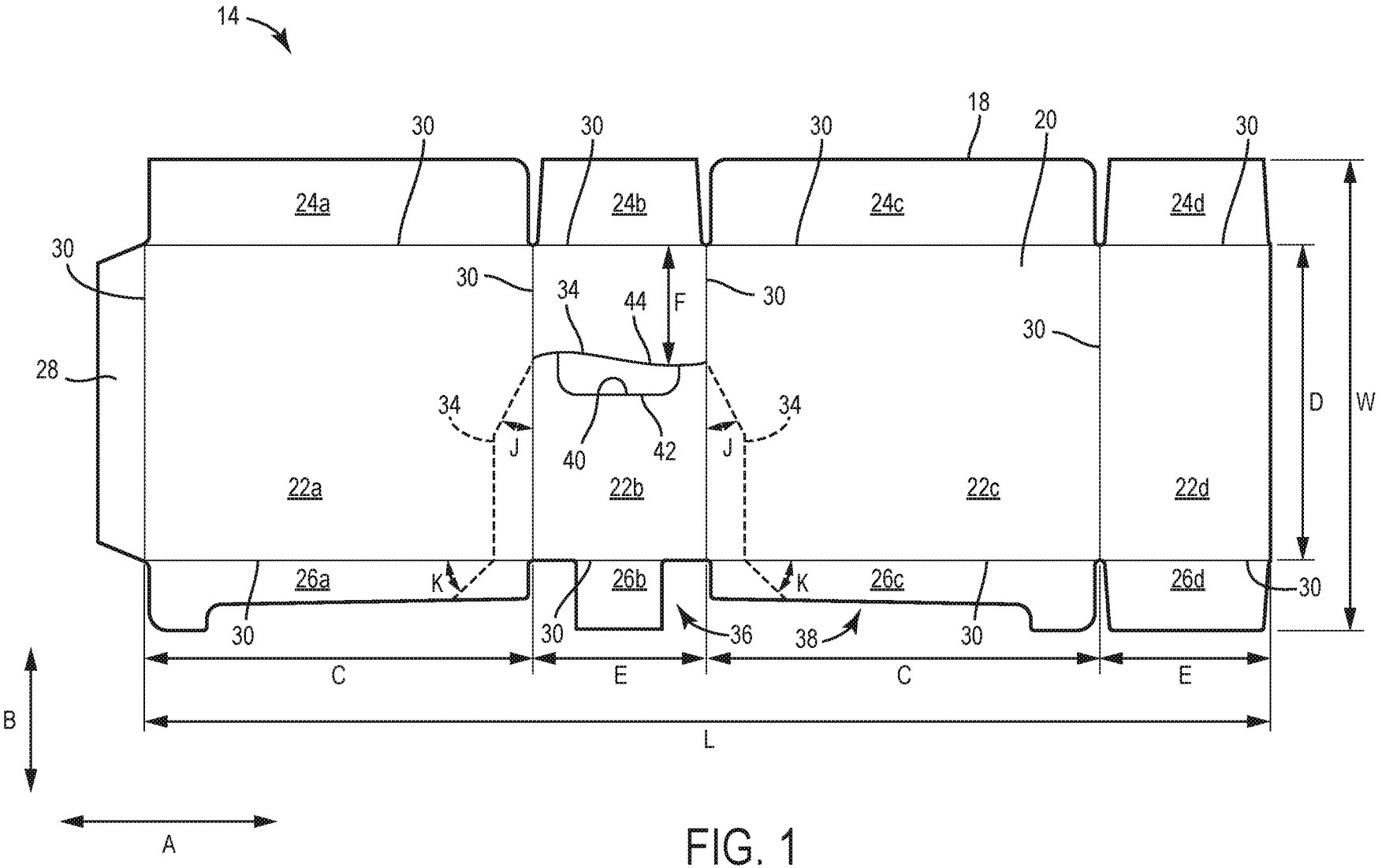
FIG. 1 is a plan view of a blank for forming a case.

Before any constructions of the disclosure are explained in detail, it is to be understood that the disclosure is not limited in its application to the details of construction and the arrangement of components set forth in the following description or illustrated in the following drawings. The disclosure is capable of other constructions and of being practiced or of being carried out in various ways.

FIGS. 1-21 illustrate a shipping container 10 convertible to a display container 12 in accordance with the present disclosure. The shipping container 10 is formed from a case 52 and a tear support piece 16. The case 52 is formed from a blank 14 and is divisible into a tear portion 36 and a display portion 38.

Figure 2:
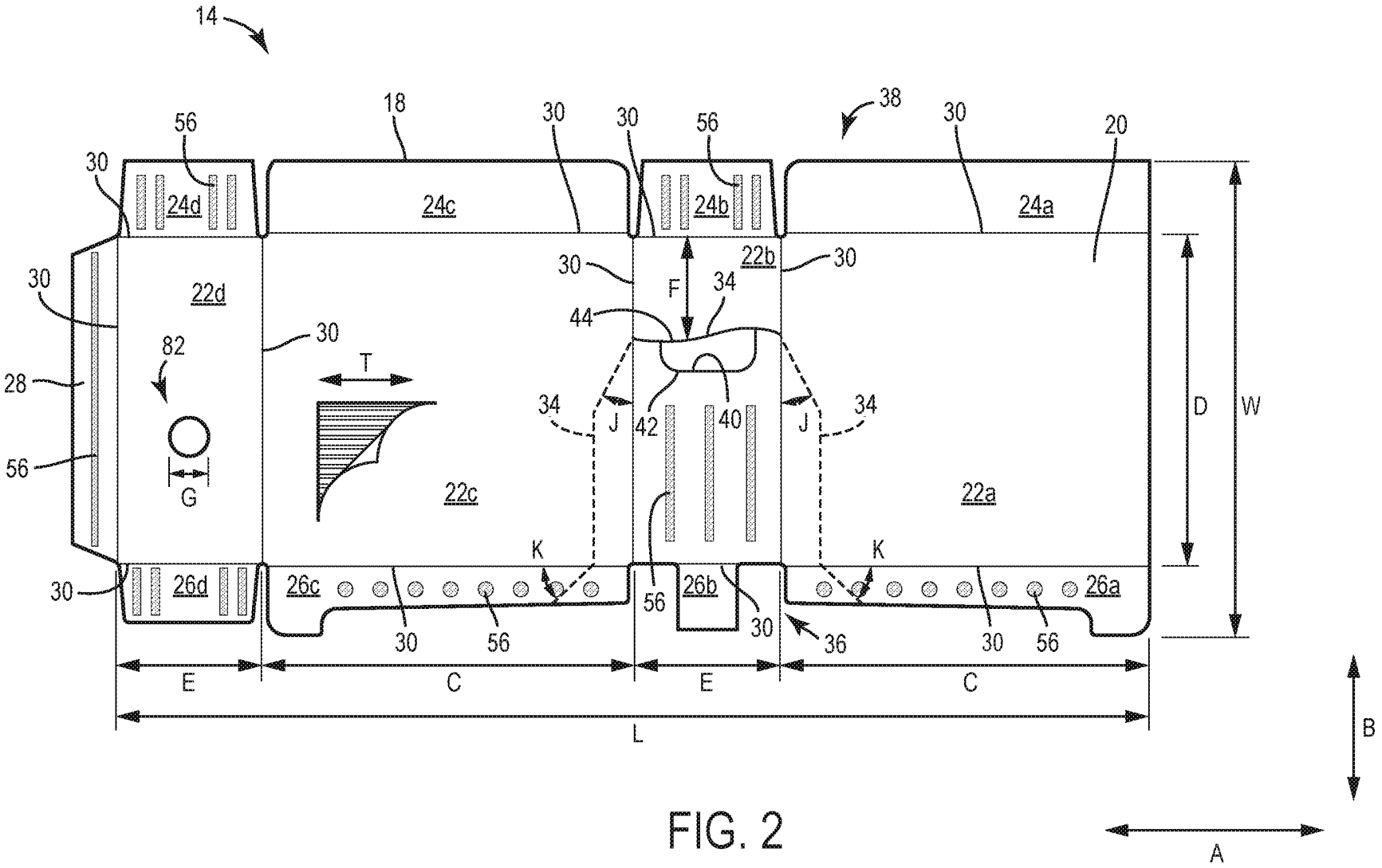
FIG. 2 is a plan view of another construction of the blank for forming a case.
Figure 4:
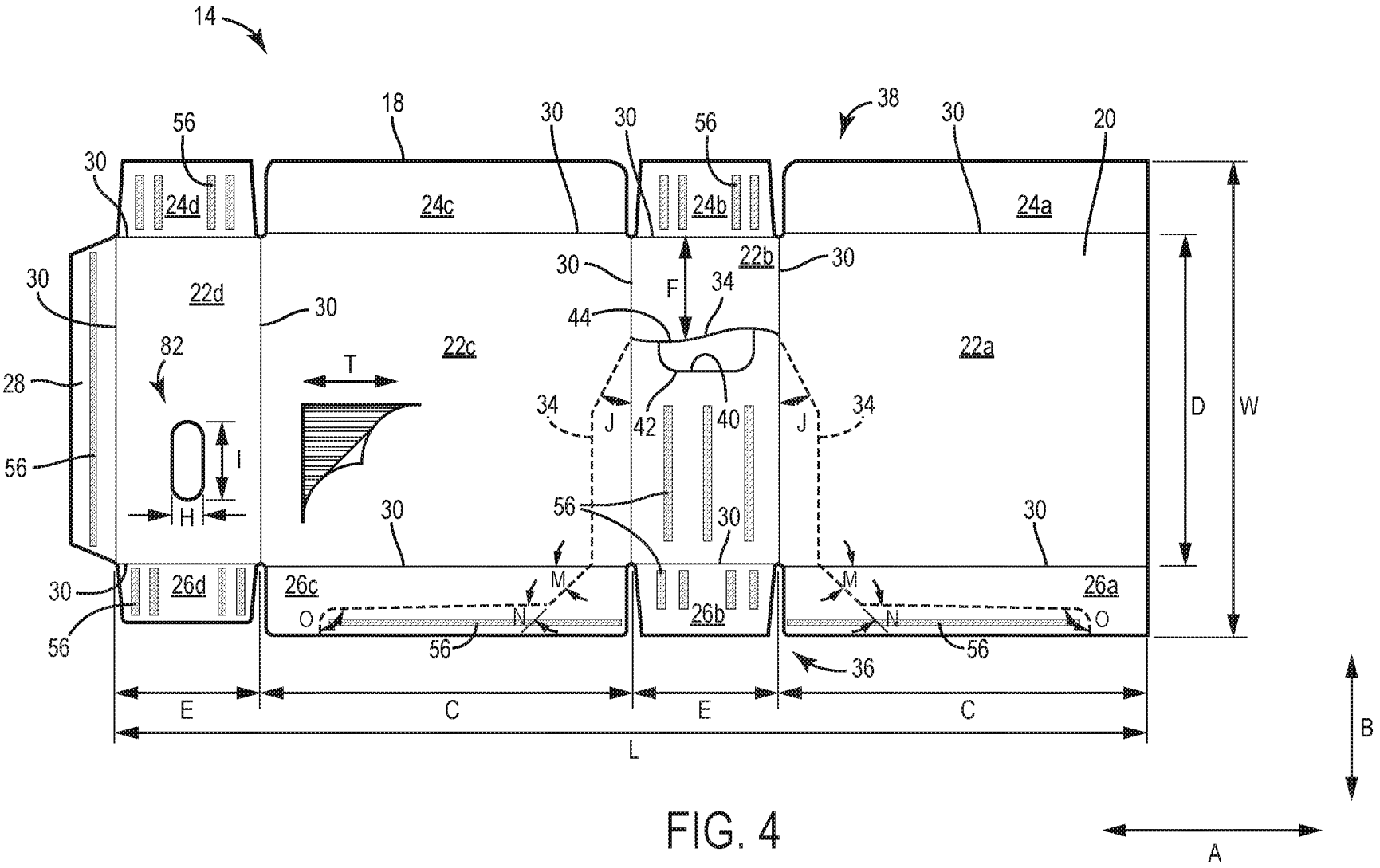
FIG. 4 is a plan view of another blank for forming a case.
Figure 5:
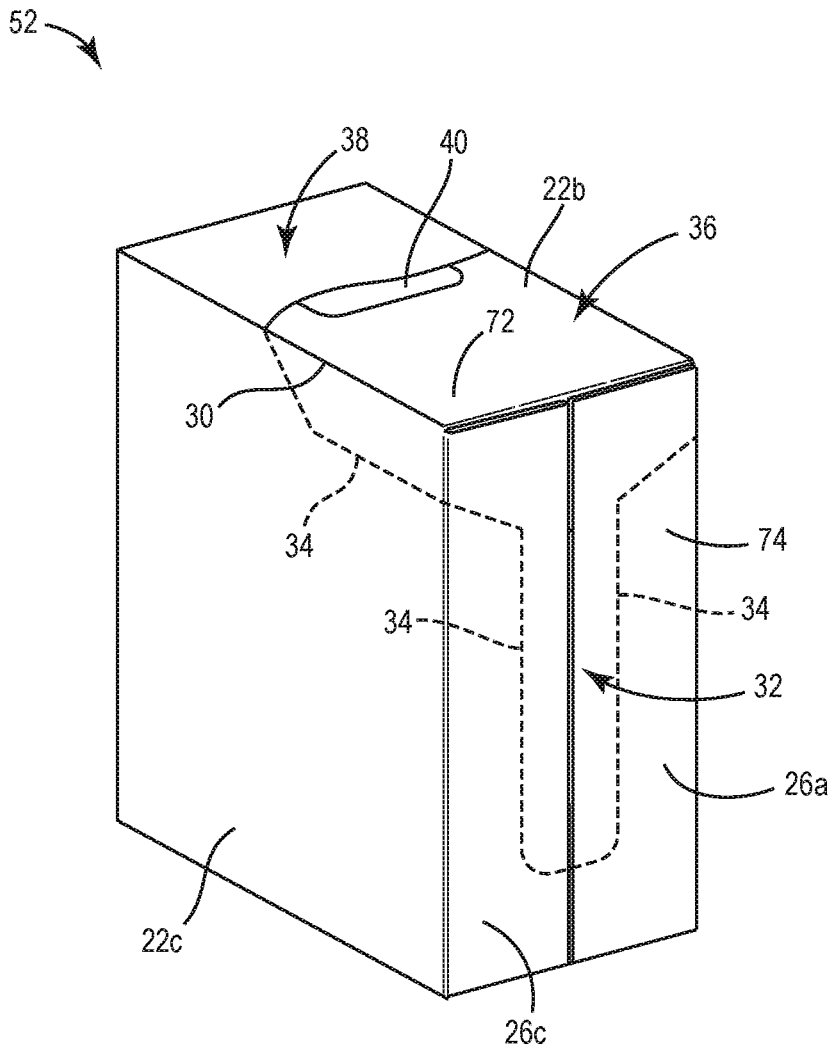
FIG. 5 is a perspective view of another case formed from the blank shown in FIG. 4.

With reference to FIGS. 1, 2 and 4, the blank 14 is shown in a first configuration, or pre-assembly configuration. In the illustrated construction, the blank 14 is generally planar in the first configuration and may have the same or varying thickness in generally the same plane; however, in other constructions, the blank 14 may be bent or curved. The blank 14 may be formed from a piece of material 18, such as a stock material that is cut into the blank 14 or a material formed directly as the blank 14. In the illustrated construction, the blank 14 is formed from a piece of corrugated cardboard, which may have sinusoidal corrugations or other suitable types of corrugations. For example, in FIGS. 2 and 4, the blank 14 has a corrugation direction T that extends generally in a longitudinal direction A of the blank 14. However, other types of materials, such as other types of cardboard, card stock, other paper materials, fibers, fabrics, plastics, polymers, resins, metals, composites, etc., or any mixture thereof, may be employed.

In the illustrated construction, the blank 14 includes a generally planar main body 20 having a plurality of sections 22*a*-22*d* and flaps 24*a*-24*d*, 26*a*-26*d*, 28 defined by fold lines 30 (as will be described with reference to the drawings in greater detail below). The overall dimensions of the blank 14 are defined by a length L in a flute direction, also referred to herein as the longitudinal direction A, and a width W in a direction B, perpendicular to the longitudinal direction A. The overall dimension of the blank 14 may range from about 4 ft. in width W by 10 ft. in length L to about 2 in. in width W by 8 in. in length L. In the illustrated constructions, the overall dimensions of the blank 14 are about 20 in. to about 40 in. in length L in the longitudinal direction A by about 6 in. to about 18 in. in width W in direction B, though the blank 14 may also be scaled, skewed, or disproportionately enlarged or reduced to any other size. More specifically, in FIG. 1, which illustrates a first construction of the blank 14, the overall dimensions of the blank 14 are about 29 in. in length L by about 12 in. in width W. In FIG. 2, which illustrates a second construction of the blank 14, the overall dimensions of the blank 14 are about 28 in. by about 13 in. In FIG. 4, which illustrates a third construction of the blank 14, the overall dimensions of the blank 14 are about 28 in. by about 12½ in. Other dimensions are also possible. In the context of the length L and the width W, the term "about" means plus or minus one inch (e.g. 29±1 in. by 12±1 in. in FIG. 1).

The fold lines 30 may be formed as straight or curved scores, cuts, bends, creases, perforations, slits, etc., or in any other suitable manner, and in any combination, in the piece of material 18. The fold lines 30 are configured to facilitate folding, or bending, of the blank 14 along predetermined paths to form a three-dimensional shape defining a chamber 32, or receptacle, as will be described in greater detail below. The blank 14 includes first, second, third, and fourth sections 22*a*, 22*b*, 22*c*, 22*d* (respectively) arranged consecutively in the flute direction, or longitudinal direction A. Each section 22*a*, 22*b*, 22*c*, 22*d* is generally rectangular and generally defined between the fold lines 30; however, in other constructions, each section 22*a*, 22*b*, 22*c*, 22*d* may have any desired shape, such as triangular, square, pentagonal, etc. A first lower flap 24*a* extends from an end of the first section 22*a*, and a first upper flap 26*a* extends from a generally opposite and/or parallel end of the first section 22*a*. A side flap 28 extends from a side of the first section 22*a* generally perpendicular to the first lower flap 24*a* and the first upper flap 26*a*. However, in other constructions, the side flap 28 may extend from any of the first, second, third, and fourth sections 22*a*-22*d* and the blank 14 may be adjusted accordingly. For example, in FIGS. 2 and 4, the side flap 28 extends from a side of the fourth section 22*d* generally perpendicular to the fourth lower flap 24*d* and the fourth upper flap 26*d* as shown in the second construction (FIG. 2) and the third construction (FIG. 4) of the blank 14. The second section 22*b* is disposed between the first and third sections 22*a*, 22*c* and includes a second lower flap 24*b* extending therefrom, the second lower flap 24*b* being adjacent the first lower flap 24*a*. A second upper flap 26*b* extends from the second section 22*b* generally opposite and/or parallel to the second lower flap 24*b*. The third section 22*c* is disposed between the second section 22*b* and the fourth section 22*d*. A third lower flap 24*c* extends from the third section 22*c* and a third upper flap 26*c* extends from the third section 22*c* generally opposite the third lower flap 24*c*. The fourth section 22*d* is disposed adjacent the third section 22*c*. The first section 22*a* and the fourth section 22*d* are generally disposed at opposite ends of the blank 14 in the longitudinal direction A. A fourth lower flap 24*d* extends from the fourth section 22*d* adjacent the third lower flap 24*c*, and a fourth upper flap 26*d* extends from the fourth section 22*d* generally opposite and/or parallel to the fourth lower flap 24*d*. The lower and upper flaps 24*a*-24*d*, 26*a*-26*d* are generally rectangular but may be tapered and/or may include additional tabs and/or cutouts.

The dimensions of the plurality of sections 22*a*-22*d* of the main body 20 are defined by a length and a height for each section 22*a*, 22*b*, 22*c*, 22*d* and may have different lengths in the longitudinal direction A or different heights in the direction B. For example, in the first, second, and third construction of the blank 14, some of the plurality of sections 22*a*-22*d* have different lengths in the longitudinal direction A but have a similar height D in the direction B. The first and third section 22*a*, 22*c* are defined by a length C in the longitudinal direction A and a height D in the direction B.

The length C is between about 3 in. and about 8 ft. More specifically, the length C is between about 6 in. and about 30 in. Even more specifically, the length C is between about 8 in. and about 12 in. In the construction of FIG. 1, the length C is about 9.8 in. In the construction of FIGS. 2 and 4, the length C is about 9.7 in.

The height D is between about 3 in. and about 8 ft. More specifically, height D is between about 6 in. and about 30 in. Even more specifically, the height D is between about 6 in. and about 12 in. In the construction of FIG. 1, the height D is about 8 in. In the construction of FIGS. 2 and 4, the height D is about 8.8 in.

The first and third sections 22*a*, 22*c* may also be scaled, skewed, or disproportionately enlarged or reduced to any other size. Other dimensions are also possible.

The second and fourth sections 22*b*, 22*d* are defined by a width E in the longitudinal direction A and the height D in the direction B. The width E is between about 1 in. and about 8 ft. More specifically, width E is between about 1 in. and about 30 in. Even more specifically, the width E is between about 1 in. and about 7 in. In the construction of FIGS. 1, 2, and 4, the width E is about 4 in.

The second and fourth sections 22*b*, 22*d* may also be scaled, skewed, or disproportionately enlarged or reduced to any other size. Other dimensions are also possible.

In the context of the length C, the width E, and the height D, the term "about" means plus or minus one inch (e.g. 9.8±1 in. in the length C by 4±1 in. in the width E by 8±1 in. in the height D in the construction of FIG. 1).

The blank 14 also includes tear lines 34 formed as straight or curved scores, cuts, bends, creases, perforations, slits, etc., or in any other suitable manner, and in any combination, in or through the piece of material 18. The tear lines 34 generally divide the blank 14 into a tear portion 36 and a display portion 38, which will be described in greater detail below. The tear lines 34 are configured to facilitate division, separation, removal, and/or detachment of the tear portion 36 from the display portion 38 such that the tear portion 36 is removable, preferably cleanly and predictably along predetermined paths (e.g., along the tear lines 34) while reducing unpredictable tears. The tear lines 34 extend at least partially across the first upper flap 26*a*, the first section 22*a*, the second section 22*b*, the third section 22*c*, and the third upper flap 26*c*. The tear portion 36 generally includes portions of the first upper flap 26*a*, the first section 22*a*, the second section 22*b*, the third section 22*c*, and the third upper flap 26*c* as well as the entire second upper flap 26*b*. The tear portion 36 preferably includes more than half of the second section 22*b* and relatively smaller elongated portions of the first and third sections 22*a*, 22*c* directly adjacent the second section 22*b*. For example, the tear lines 34 begin at a central location on the second section 22*b* and expand continuously outwards from (away from) or parallel to the second section 22*b* on both sides. Specifically, the tear lines 34 in the first and third sections 22*a*, 22*c* are angled by an angle J of about 10 to about 80 degrees, or more specifically of about 25 to about 35 degrees (e.g., about 27 degrees in FIG. 1) from a reference line in the direction B (e.g., the nearest fold line 30). Referring to FIGS. 1 and 2, the tear lines 34 in the first and third upper flaps 26*a*, 26*c* are angled by an angle K of about 10 to about 80 degrees, or more specifically of about 30 to 40 degrees (e.g., about 45 degrees in FIG. 1) from the nearest reference line in the direction B. Referring to FIG. 4, the tear lines 34 in the first and third upper flaps 26*a*, 26*c* are angled by an angle M, an angle N, and an angle O of about 10 to about 90 degrees from the reference line in the direction B. More specifically, angle M is about 40 to about 50 degrees, or about 45 degrees, angle N is about 85 to about 95 degrees, or about 90 degrees, and angle O is about 85-95 degrees, or about 90 degrees. In the context of the angle J, the angle K, the angle M, the angle N, and the angle O, the term "about" means plus or minus five degrees (e.g. angle K is 45±5 degrees in FIG. 1).

The display portion 38 generally includes a portion of the first upper flap 26*a*, a portion of the first section 22*a*, a portion of the second section 22*b*, a portion of the third section 22*c*, and a portion of the third upper flap 26*c*. The display portion 38 also includes the whole side flap 28, the first, second, third and fourth lower flaps 24*a*-24*d*, the fourth upper flap 26*d*, and the fourth section 22*d*.

The blank 14 also includes a handle 40 adjacent to or sharing an edge with the tear lines 34. The handle 40 may be formed as a cutout or aperture in which a user can insert fingers to grip the case 52, a partial cutout (e.g., cut on two or three sides) bendable and/or breakable to form an aperture, a perforated aperture or cutout, a tab grippable by the user, etc. In FIG. 1, the handle 40 is formed with an aperture having three adjacent sides 42, which form a generally rectangular configuration with two rounded corners. In FIGS. 2-5, the handle 40 is formed with an aperture having two rounded sides 42 and a third side as the fold line 30 extending between the two rounded sides 42, which form a generally rectangular configuration. In FIGS. 1-5, the last side of the handle 40 is a fourth elongated side 44 having a generally curved shape. The fourth elongated side 44 of the handle 40 is generally shaped as an S-curve defining a concave edge 46 and a convex edge 48 (FIG. 18) of the display portion 38. The fourth elongated side 44 is also part of (i.e., collinear or coaxial with) the tear lines 34 forming a border between the tear portion 36 and the display portion 38. In the illustrated construction, the fourth elongated side 44 is defined by a cut all the way through the piece of material 18 extending all the way across the second section 22*b* from an intersection with the first section 22*a* to an intersection with the third section 22*c*.

Referring to FIGS. 2 and 4, the blank 14 may also include a viewing hole 82 positioned on the fourth section 22*d* and opposite of the second section 22*b* having the handle 40 when formed into the case 52. In the illustrated construction, the viewing hole 82 is generally located in the middle of the fourth section 22*d* in the longitudinal direction A and closer to the upper flap 26*d* in the direction B. In other constructions, the viewing hole 82 may be located on any of the sections 22*a*-22*d* or located at any point on the sections 22*a-d* in the longitudinal direction A and in the direction B. The viewing hole 82 may be formed as a cutout, or aperture, in the blank 14 in which the viewing hole 82 has a generally circular shape. In other constructions, the viewing hole 82 may have any desired shape, such as triangular, rectangular, square, pentagonal, etc. For example, in FIG. 2, the viewing hole 82 is formed as an aperture having a generally circular shape and defined by a diameter G of about 0.5 in. to about 24 in, though the viewing hole 82 may also be scaled, skewed, or disproportionately enlarged or reduced to any other size. More specifically, diameter G is about 1 in. in FIG. 2. In the context of the diameter G, the term "about" means plus or minus one quarter inch (e.g. diameter G is 1±0.25 in. in FIG. 2). Referring to FIG. 4, the viewing hole 82 is formed as an aperture having a generally rectangular shape and defined by a length H and a width I of about 0.5 in. to about 12 in. in the length H by about 1 in. to about 24 in. in the width I, though the viewing hole 82 may also be scaled, skewed, or disproportionately enlarged or reduced to any other size. More specifically, the length H is about 1 in. and the width I is about 2 in. in FIG. 4. In the context of the length H and the width I, the term "about" means plus or minus a quarter inch (e.g. the length H is 1±0.25 in. in FIG. 4). Notably, in the illustrated construction, the viewing hole 82 is located on the display portion and generally located opposite the second section 22*b* having the handle 40, which will be explained in greater detail below.

Further referring to FIGS. 2 and 4, a user may use a fastener 56 such as adhesive (e.g., glue, paste, epoxy, etc.), staples, interlocking tabs, etc. in order to configure the case 52 from the blank 14 and to configure the shipping container 10 from the case 52 and the tear support piece 16. FIGS. 2 and 4 illustrate where glue 56 may be applied by a user. For example, in FIGS. 2 and 4, glue 56 is applied in parallel lines in the direction B on the second lower flap 24*b* and fourth lower flap 24*d*, the fourth upper flap 26*d*, and the portion of the second section 22*b* included in the tear portion 36. Moreover, glue 56 is applied in a generally straight line on the side flap 28. Furthermore, glue 56 is applied as consecutive dots on substantially the length of the first upper flap 26*a* and the third upper flap 26*c* in the longitudinal direction A in FIG. 2, and applied as a generally straight line on substantially the length of the first upper flap 26*a* and the third upper flap 26*c* in the longitudinal direction A in FIG. 4. Glue 56 is also applied in four parallel lines in the direction B to the second upper flap 26*b* in FIG. 4. Any type of fastening or fasteners as discussed above, as well as, any type of pattern or direction of applying the fastener may be used in order to configure the case 52 from the blank 14 and to configure the shipping container 10 from the case 52 and the tear support piece 16. Glue 56, or any other suitable fastener, applied to any of the flaps and/or sections will be explained in greater detail below.

Figure 3:
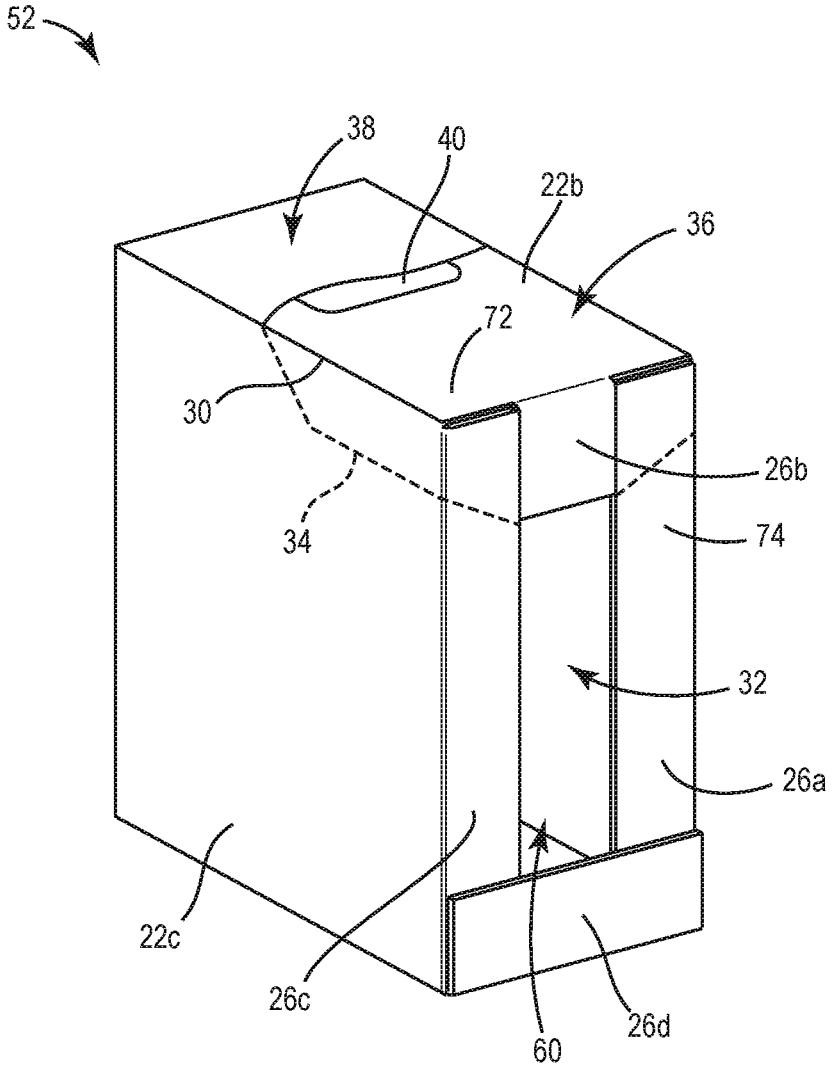
FIG. 3 is a perspective view of the case formed from the blank shown in FIG. 1 or FIG. 2.
Figure 6:
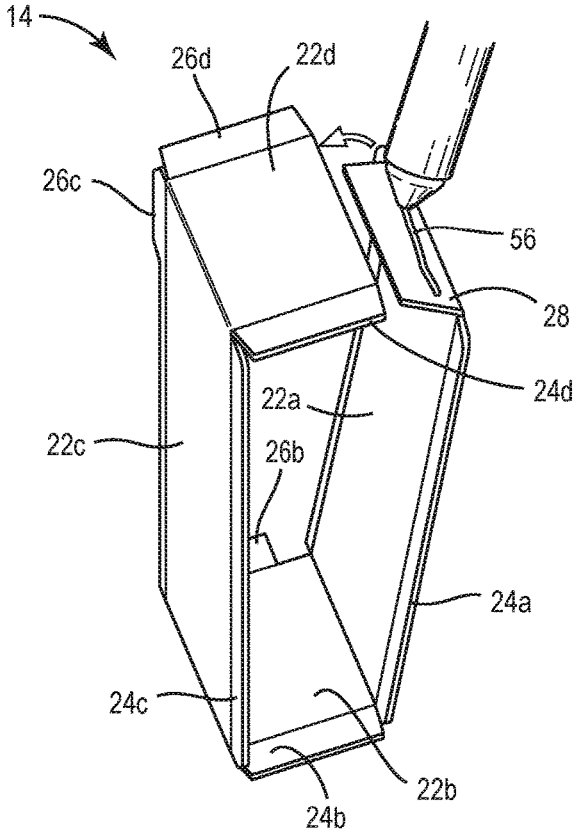
FIGS. 6-9 are perspective views of the blank shown in FIG. 1 or FIG. 2 being formed into the case shown in FIG. 3.
Figure 7:
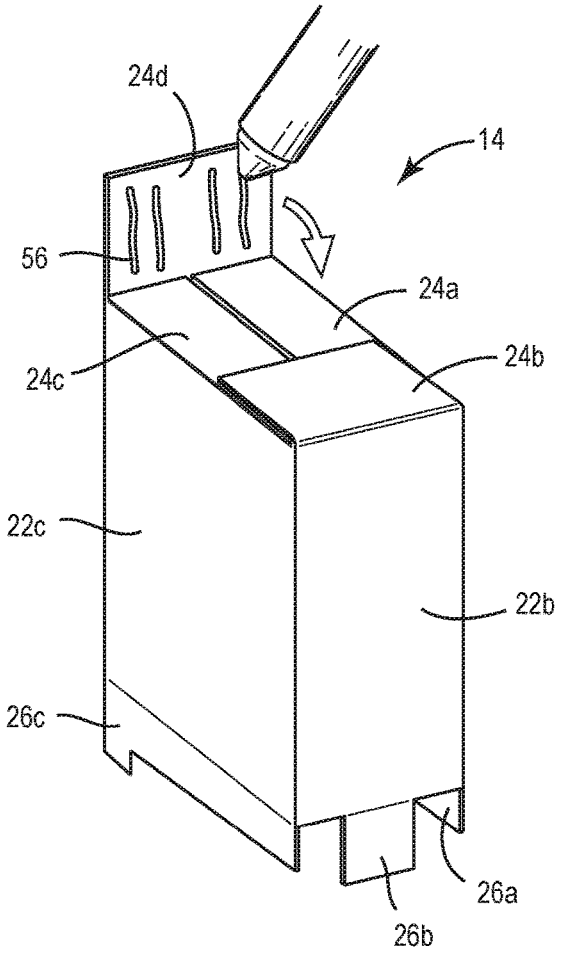

The blank 14 is reconfigurable into a second configuration (FIGS. 3 and 5), or shipping configuration, i.e., into the case 52 or carton (the terms being used interchangeably herein) configured to at least partially enclose or fully enclose a product 54 (FIGS. 6-9) for shipping. The blank 14 is reconfigurable into the case 52 by one or more of bending, folding, gluing, etc. In the second configuration, one example of which is illustrated in FIG. 3, the blank 14 is reconfigured into the case 52 by folding along the fold lines 30 and gluing along one or more of the sections 22*a*-22*d* and flaps 24*a*-24*d*, 26*a*-26*d*, 28. In the illustrated construction, glue 56 is applied between the side flap 28 and the fourth section 22*d* (FIG. 6). Glue 56 is also applied between the second lower flap 24*b* and the first lower flap 24*a*, between the second lower flap 24*b* and the third lower flap 24*c*, between the fourth lower flap 24*d* and the first lower flap 24*a* and between the fourth lower flap 24*d* and the third lower flap 24*c* (FIG. 7). Glue is also applied between the fourth upper flap 26*d* and the first upper flap 26*a* and between the fourth upper flap 26*d* and the third upper flap 26*c* (FIG. 9). In other constructions, glue 56, or any other suitable fastener, may be applied to any of the flaps and/or sections to achieve the desired three-dimensional structure. For example, referring to FIG. 10, the glue 56 is applied between the second upper flap 26*b* and the first upper flap 26*a* and between the second upper flap 26*b* and the third upper flap 26*c*. Glue is also applied between the fourth upper flap 26*d* and the first upper flap 26*a* and between the fourth upper flap 26*d* and the third upper flap 26*c*.

As one specific example, the blank 14 is reconfigurable into the case 52 in steps as shown in FIGS. 6-9. This description of conversion of the blank 14 into the case 52 generally applies to all constructions of the blank 14 disclosed herein, including the blanks 14 shown in FIGS. 1, 2, and 4, though it should be understood that some of the conversion steps may be varied in order to accommodate variations in the blank design, as can be easily understood knowing the structure of the blanks 14. In FIG. 6, the user folds the first, second, third and fourth sections 22*a*-22*d* along the fold lines 30 and fastens the side flap 28 to one of the sections 22*a*-22*d* (e.g., to the fourth section 22*d* with reference to the blank 14 shown in FIG. 1, or to the first section 22*a* with reference to the blank 14 shown in FIGS. 2 and 4, or to another one of the sections 22*a*-22*d* in alternative structures of the blank 14) to form a generally tubular shape. For example, the user may use the fastener 56 such as adhesive (e.g., glue, paste, epoxy, etc.), staples, interlocking tabs, etc. In the illustrated construction, the user applies glue 56 to the side flap 28 and/or the one of the sections 22*a*-22*d* and fastens the side flap 28 to the one of the sections 22*a*-22*d* to form the tubular shape. Thus, the first, second, third and fourth sections 22*a*-22*d* form first, second, third, and fourth sides of the case 52.

As shown in FIG. 7, the user substantially closes one open end of the tubular shape by folding the lower flaps 24*a*-24*d* along the fold lines 30 and fastening the lower flaps 24*a*-24*d* to each other. Thus, the lower flaps 24*a*-24*d* form a fifth (e.g., bottom) side of the case 52.

Figure 8:
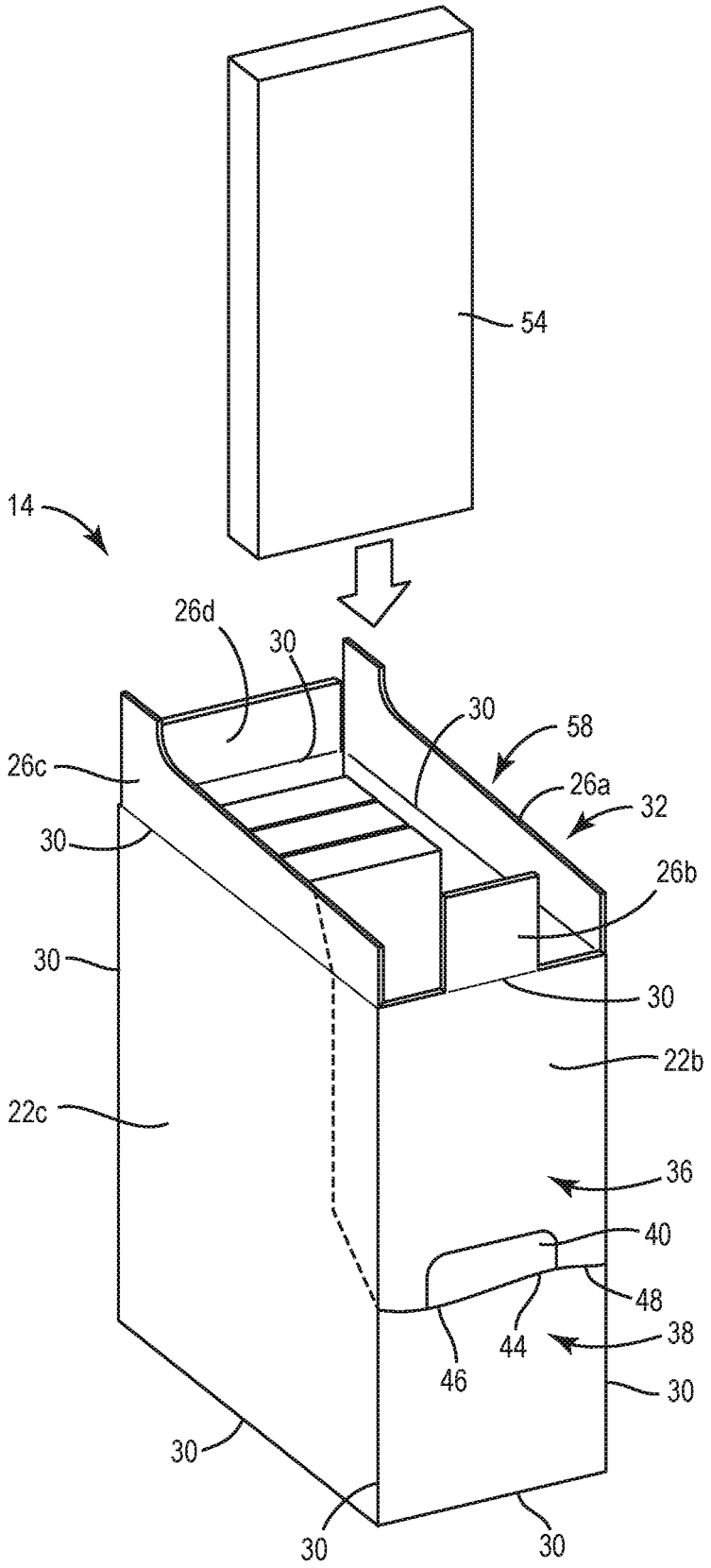
Figure 9:
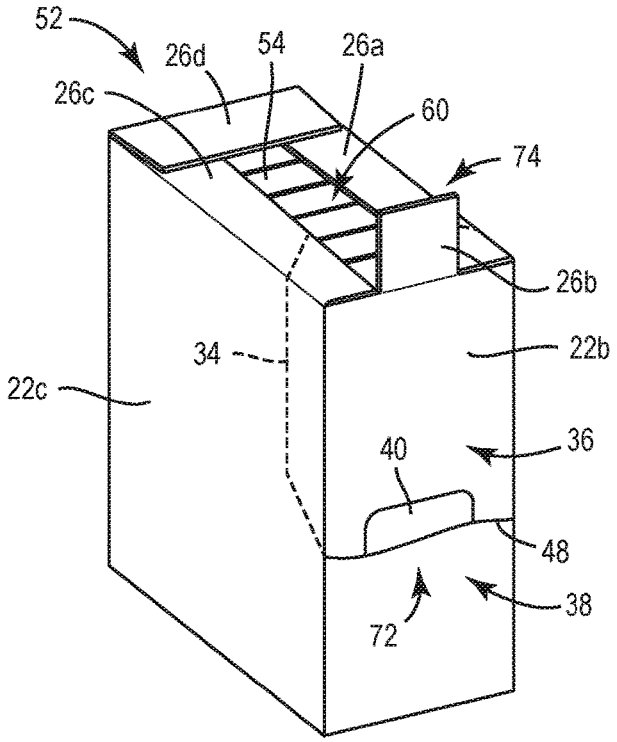

As shown in FIG. 8, the case 52 now has an open end 58 (e.g., a single open end) providing access to the chamber 32. The user may load the product 54 into the chamber 32 through the open end 58, as shown. The case 52 may be loaded by dropping or pushing the product 54 into the chamber 32 manually or automatically by machine. The case 52 may be loaded while oriented vertically or horizontally in any desired orientation. The product 54 may also be loaded vertically or horizontally in any desired orientation such that the product 54 lies flat or upright as desired. In the illustrated construction, the product 54 includes packages being elongated. The elongation of the product 54 is aligned within the case 52 from the fifth (e.g., bottom) side of the case 52 to the side of the case 52 including the open end 58, or a sixth (e.g., top) side of the case 52, as further discussed below. The elongation of each of the products 54 defines an axis of elongation that intersects the fifth (e.g. bottom) side and the sixth (e.g., top) side. The product 54 is disposed in the case 54 such that the product packages are arranged side-by-side in the chamber 32 in a single row in which the packages are substantially parallel to the next package.

Figure 10:
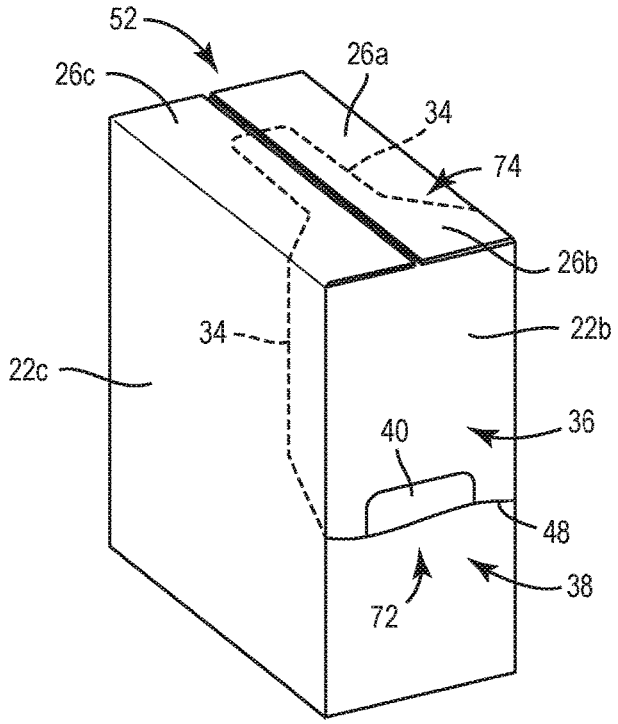
FIG. 10 is another perspective view of the case shown in FIG. 5 formed from the blank shown in FIG. 4.

When the case 52 is loaded with the product 54, the user may fold and fasten some or all of the upper flaps 26*a*-26*d* as illustrated in FIG. 9. For example, the user folds along the fold lines 30 and fastens the first, third, and fourth upper flaps 26*a* 26*c*, 26*d*. The upper flaps 26*a*-26*d* may not entirely enclose the chamber 32 and may, for example, define an opening 60 (as is the case with respect to the blanks 14 shown in FIGS. 1 and 2). However, all of the upper flaps 26*a*-26*d* aid with securing the product 54 by providing a sixth wall of the case 52 such that the product 54 is at least partially enclosed from all 6 sides. The upper flaps, including the upper flap 26*b*, may inhibit the product 54 from extending outside a plane of the sixth wall of the case 52 or onto the glued upper flaps 26*a*, 26*c*. In the construction corresponding to the blank 14 shown in FIG. 4, the user folds along the fold lines 30 and fastens the first, second, third, and fourth upper flaps 26*a*, 26*b*, 26*c*, and 26*d*, effectively enclosing the chamber 32, as shown in FIG. 10. For example, the user may fold the second and fourth upper flaps 26*b*, 26*d* over the open end 58 and use glue 56, or any other suitable fastener, to fasten the first and second section 26*a*, 26*c* to the top, or outside, of the second and fourth upper flaps 26*b*, 26*d*, effectively forming the sixth (e.g., top) side of the case 52.

Thus, the case 52 may include a plurality of walls or sides defining and at least partially enclosing the chamber 32 inside for receiving the product 54. For purposes of description herein, a first side 72 is defined as the side having the handle 40 and a second side 74 is defined as the adjacent side including the upper flaps 26*a*-*d*. The walls may be generally planar or curved. The case 52 may form, for example, a polyhedron shape at least partially enclosing the chamber 32. In the illustrated construction, the case 52 includes six orthogonal sides forming a generally parallelepiped structure, such as a rectangular cuboid, in which the sides substantially enclose the chamber 32. However, any other three dimensional enclosure of any shape may be employed. Furthermore, the sides of the case 52 substantially enclose the chamber 32 on all sides of the case 52 such that the product 54 is contained in the chamber 32 (FIGS. 9-10). When assembled, the tear portion 36 is at least partially disposed on at least two sides of the case 52. For example, in the illustrated construction, the tear portion 36 is partially defined on four sides of the case 52. The tear portion 36 defines at least 30% of the total surface area on one of the sides of the case 52 (e.g. the first side 72 in FIGS. 9 and 10 and/or the second side 74 in FIG. 10) and defines less than 30% of the total surface area on two of the other two sides (e.g. the side including the first section 22*a* and the side including the third section 22*c*). Furthermore, at least two of the sides of the tear portion 36 are adjacent. For example, as shown in FIGS. 9 and 10, the tear portion 36 is disposed on the first side 72 and the second side 74 adjacent to the first side 72.

The case 52 is sized generally to receive a plurality of the product 54, such as food products. The case 52 inner dimensions are similar to the corresponding dimensions of the blank 14 (e.g., length C, height D, width E) and should be understood to be illustrated, by way of the blank 14, in FIGS. 1, 2, and 4. The case 52 outer dimensions are also similar to the corresponding dimensions of the blank 14 discussed above, but may include a slight addition to account for material thickness on all sides (e.g., by adding 0.0625 in. to 1.0 in. to the dimension). Thus, overall, the case 52 dimensions may range from about 1 in. cuboid to about 6 feet cuboid. More specifically, the case 52 inner dimensions range from about 2 in. cuboid to about 36 in. cuboid. Even more specifically, the case 52 inner dimensions range from about 2 in. cuboid to about 24 in. cuboid. Even more specifically, the case 52 inner dimensions range from about 2 in. cuboid to about 16 in. cuboid. In the illustrated construction applying the blank 14 of FIG. 1, the case 52 may have the inner dimensions of about 8 in. by about 4 in. by about 10 in., e.g., 7.9 in. by about 4.3 in. by about 9.7 in. In the illustrated construction applying the blank 14 of FIG. 2, the case 52 may have inner dimensions of about 9 in. by about 4 in. by about 10 in., e.g., 8.8 in. by about 4.1 in. by about 9.7 in. In the illustrated construction applying the blank 14 of FIG. 4, the case 52 may have inner dimensions of about 9 in. by about 4 in. by about 10 in., e.g., 8.8 in. by about 4.1 in. by about 9.7 in. In the context of the inner dimensions, the term "about" means plus or minus 2 in. (e.g. 8±2 in. by 4±2 in. by 10±2 in.). Other dimensions are also possible.

Figure 11:
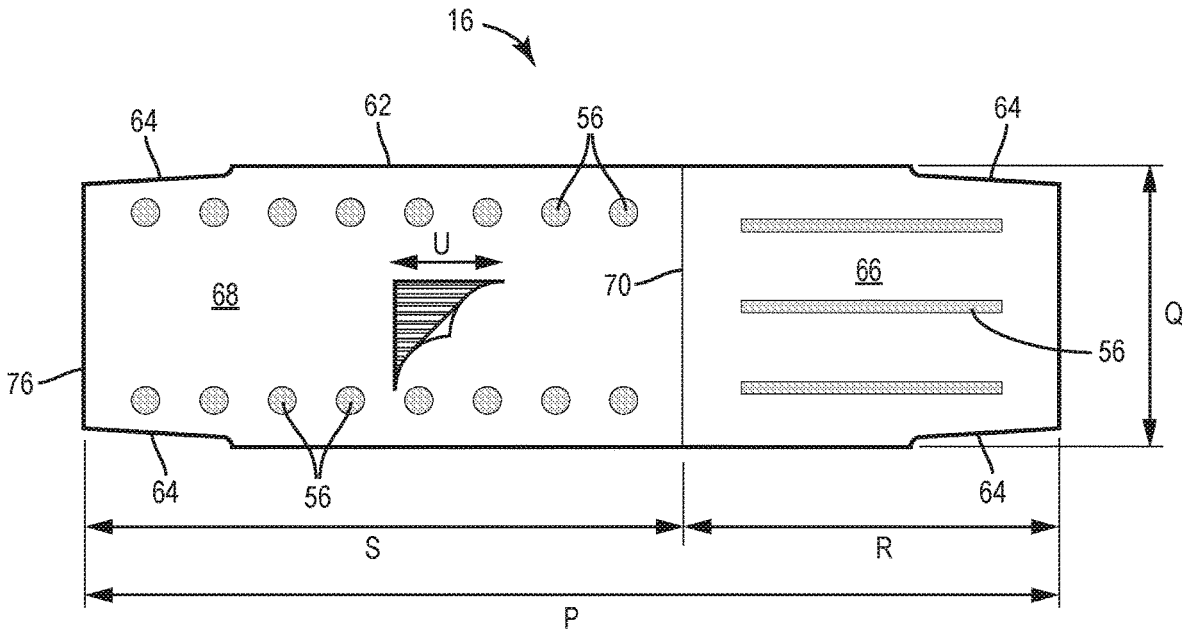
FIG. 11 is a plan view of a tear support piece.
Figure 12:
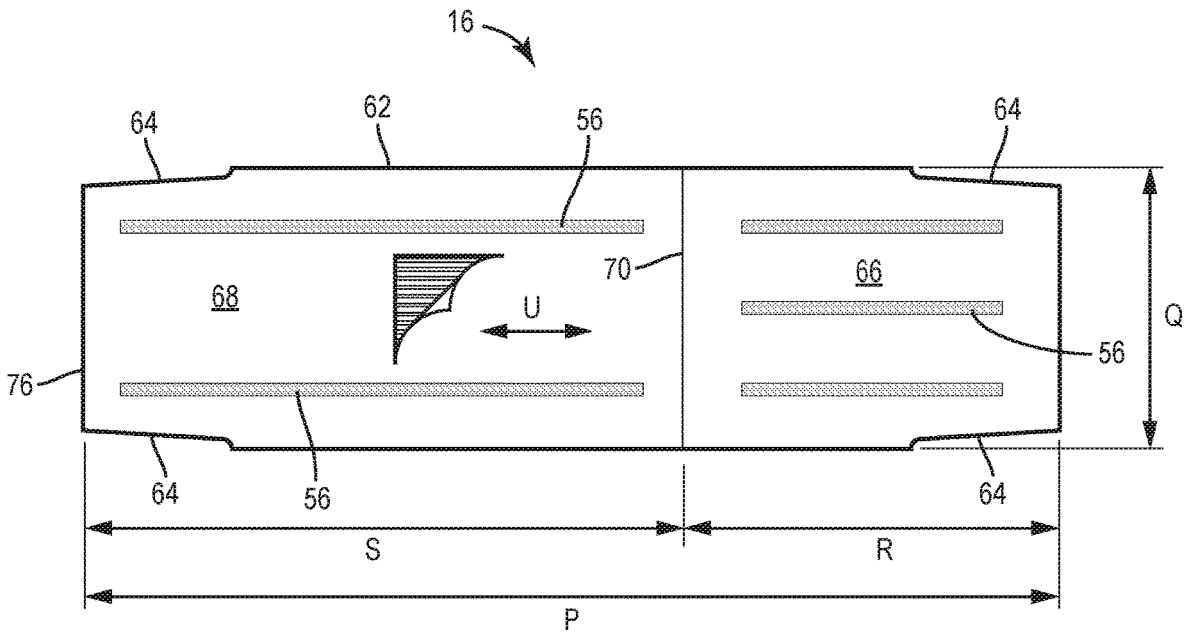
FIG. 12 is a plan view of another construction of the tear support piece.
Figure 13:
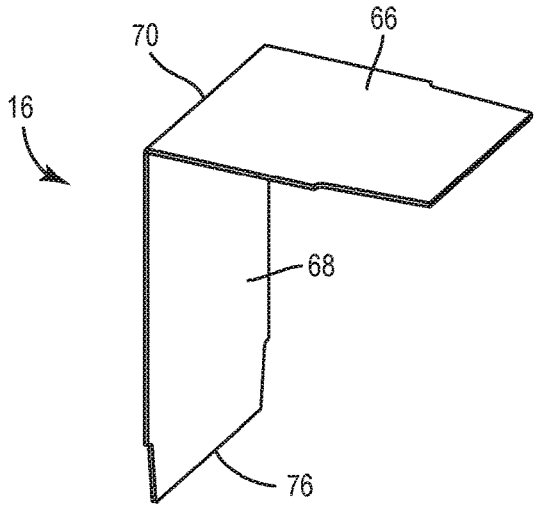
FIG. 13 is a perspective view of the tear support piece shown in FIG. 11 or FIG. 12 being folded.

FIGS. 11-13 illustrate the tear support piece 16. In a preferred construction, the tear support piece 16 is a separate piece of material 62 from the blank 14, meaning that the tear support piece 16 is not merely a flap of the blank 14 formed along fold lines, but an unattached piece. However, in other constructions, the tear support piece 16 may be coupled to the blank 14, formed with the blank 14, integrated into the blank 14 (e.g., as an additional layer of material), etc. In the illustrated construction, the tear support piece 16 is generally planar and may have the same or varying thickness in generally the same plane; however, in other constructions, the tear support piece 16 may be bent or curved. The tear support piece 16 may be formed from a piece of material 62, such as a stock material that is cut into the tear support piece 16 or a material formed directly as the tear support piece 16. In the illustrated construction, the tear support piece 16 is formed from a piece of corrugated cardboard, which may have sinusoidal corrugations or other suitable types of corrugations. For example, in FIGS. 11-12, the tear support piece 16 has a corrugation direction U. The tear support piece 16 may be formed from the same or a different type of material from the blank 14. However, other types of materials, such as other types of cardboard, card stock, other paper materials, fibers, fabrics, plastics, polymers, resins, metals, composites, etc., or any mixture thereof, may be employed.

The tear support piece 16 is generally rectangular in the illustrated construction and may include tapers 64 at opposite longitudinal ends. However, in other constructions, the tear support piece 16 may have other shapes and sizes. The tear support piece 16 includes a first section 66 and a second section 68 divided by a fold line 70. In the illustrated construction, the tear support piece 16 includes a single fold line 70 and therefore has a substantially L-shape when bent at the fold line 70; however, in other constructions, the tear support piece 16 may include two or more fold lines 70 dividing the tear support piece 16 into three or more corresponding sections. The tear support piece 16 is sized to fit within outer dimensions of the case 52 when the tear support piece 16 is bent at the fold line 70. For example, in FIGS. 11-12, the tear support piece 16 has the overall dimensions of about 5 in. to about 20 in. in the length P by about 2 in. to about 16 in. in the width Q. More specifically, the length P is about 13 in. and the width Q is about 4 in. In the context of the length P and the width Q, the term "about" means plus or minus three tenths inch (e.g. the length P is 13±0.3 in. in FIG. 11), though the length P and the width Q may take on any dimension that falls within the dimensions of the case 52. The first section 66 of the tear support piece 16 may be defined by a first section length R by the width Q. The second section 68 of the tear support piece 16 may be defined by a second section length S by the width Q. The dimensions of the first section 66 are about 2 in. to about 10 in. in the first section length R by about 2 in. to about 16 in. in the width Q, though the first section 66 may also be scaled, skewed, or disproportionately enlarged or reduced to any other size. The dimensions of the second section 68 are about 3 in. to about 18 in. in the second section length S by about 2 in. to about 16 in. in the width Q, though the second section 68 may also be scaled, skewed, or disproportionately enlarged or reduced to any other size. More specifically, the first section 66 is about 5 in. in the first section length R by about 4 in. in the width Q and the second section 68 is about 8 in. in the second section length S by about 4 in. in the width Q. In the context of the first section length R, the second section length S, and the width Q, the term "about" means plus or minus three tenths inch (e.g. the first section length R is 8±0.3 in. in FIG. 11). In other constructions, other sizes generally within the outer dimensions of the case 52 may be selected.

FIGS. 11-12 illustrate where glue 56 is applied to the tear support piece 16 in order to couple the tear support piece 16 to the case 52, which will be explained in greater detail below. A user may apply any type of fastening or fastener as discussed above, such as gluing. For example, in the illustrated construction, glue 56 is applied in parallel lines on the section 66 of the tear support piece 16, as shown in FIGS. 11-12. Furthermore, the glue 56 is applied as two lines of consecutive dots on substantially the length S of the second section 68 in FIG. 11, and applied as two lines on substantially the length S of the second section 68 in FIG. 12. Any type of fastening or fasteners as discussed above, as well as, any type of pattern or direction of applying the fastener may be used in order to couple the tear support piece 16 to the case 52.

FIG. 13 illustrates the tear support piece 16 formed in the substantially L-shape when the user bends the tear support piece 16 along the fold line 70. In other constructions, the tear support piece 16 may include two or more fold lines 70, changing the shape the tear support piece 16 forms when the user bends the tear support piece 16 along the fold lines 70. In the illustrated construction, the fold line 70 is aligned with an edge between the first and second sides 72, 74 of the case 52, as further discussed below.

Figure 14:
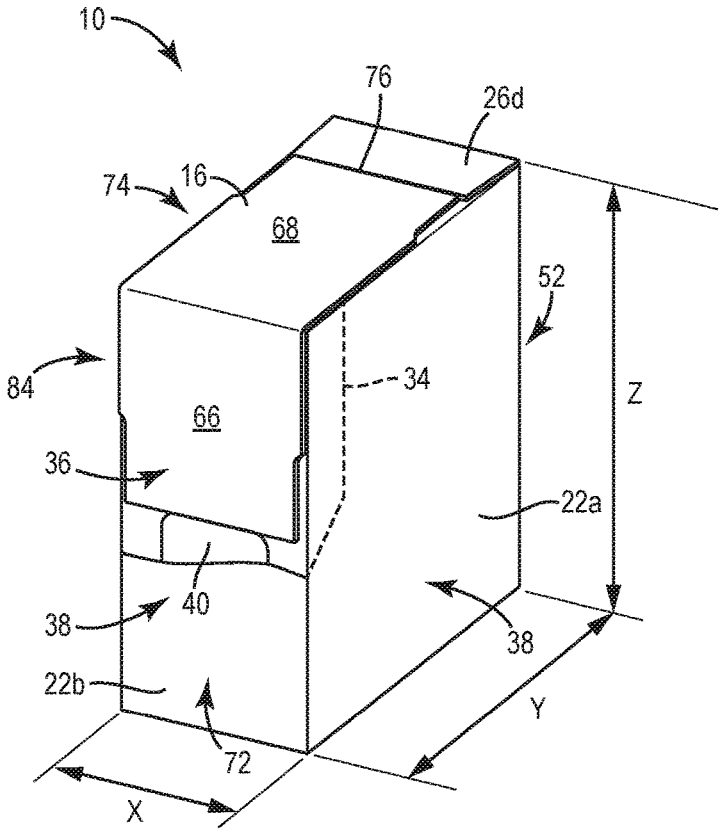
FIG. 14 is a perspective view of the tear support piece of FIG. 13 assembled with the case of FIG. 3 or FIG. 5 to form a shipping container.

FIG. 14 illustrates assembly of the shipping container 10, which includes the case 52 and the tear support piece 16 coupled together. The user takes the packed case 52 (FIG. 9 or 10) and substantially covers the second side 74 with the tear support piece 16 (FIG. 13). Specifically, the user couples the tear support piece 16 to the case 52 over the second side 74 and couples the tear support piece 16 to the tear portion 36. Even more specifically, the user may couple the tear support piece 16 (e.g., the second section 68) to or over the second side 74 and substantially cover the opening 60 of the case 52 (FIG. 9), e.g., some or all of the upper flaps **26*a*-26*d*, e.g., the first, second, and third upper flaps 26*a*-26*c*. Notably, regarding the first and second constructions of the blank 14 (relating to FIGS. 1 and 2), the tear support piece 16 is not glued to the fourth upper flap 26*d*, which will be explained in greater detail below. The user aligns the fold line 70 with an edge between the first and second sides 72, 74 of the case 52. The user also couples the tear support piece 16 (e.g., the first section 66) to or over the first side 72 (e.g., the second section 22*b*) of the case 52. Coupling may include any type of fastening or fastener discussed above, such as gluing. Thus, the tear support piece 16 is disposed on two sides 72, 74 of the case 52. However, in other constructions, the tear support piece 16 may be disposed on one side of the case 52 or three or more sides of the case 52 depending on the number of fold lines 70 on the tear support piece 16. Preferably, the tear support piece 16 is disposed in a tear zone 84 defined by the tear portion 36 (and, if the first or second blank 14 constructions are used, further defined by the opening 60) in an area generally bounded by the tear lines 34. The tear zone extends preferably onto at least two sides of the case 52. The tear support piece 16 may also preferably be disposed adjacent, or directly adjacent, to the handle 40. Referring to FIG. 14, the shipping container 10 may include either construction of the case 52 as shown in FIG. 9 or 10 such that the tear support piece 16 substantially covers the opening 60 defined by the upper flaps 26*a*-26*d* as shown in FIG. 9 or substantially covers the second side 74 formed from the upper flaps 26*a*-26*d* as shown in FIG. 10**.

As illustrated in FIGS. 9-10, the tear portion 36 of the shipping container 10 includes a first substantially planar surface, such as the second section **22*b* and/or the upper flap 26*b*, and first edges defined at least partially along a perimeter of the second section 22*b* and the upper flap 26*b*. As illustrated in FIGS. 12-13, the tear support piece 16 includes a second substantially planar surface, such as the first section 66 and/or the second section 68, and second edges defined at least partially along a perimeter of the first and second sections 66, 68. The substantially planar surface of the second section 22*b* of the case 52 is configured to be couplable to the substantially planar surface of the second section 66 of the tear support piece 16, and the substantially planar surface of the upper flap 26*b* is configured to be coupleable to the substantially planar surface of the first section 66 of the tear support piece 16. Coupling the tear support piece 16 to the case 52 planar surface to planar surface (in contrast with edge to edge) increases the thickness of the shipping container 10. In other words, the tear support piece 16 is coupled to the tear portion 36 such that the tear portion 36 provides a first layer of material and the tear support piece 16 provides a second layer of material. Moreover, the tear support piece 16 is configured to provide the second layer of material such that a thickness of the shipping container 10 increases in which the thickness is defined between an interior of the shipping container 10 and an exterior of the shipping container 10 (FIG. 14). The tear support piece 16 coupled to the tear portion 36 may thereby add rigidity to the tear portion 36 to facilitate divisibility of the tear portion 36 and the display portion 38**.

Figure 15:
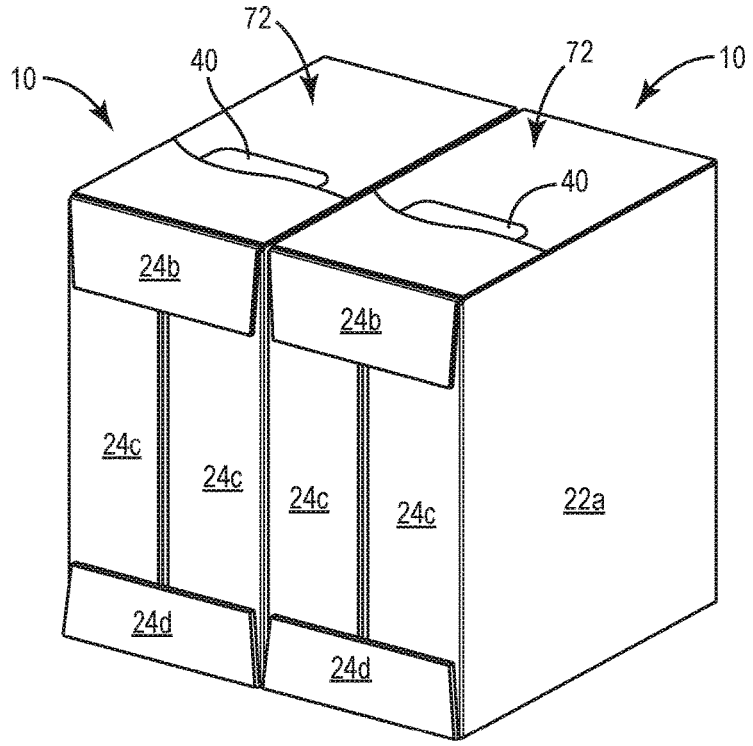
FIG. 15 is a perspective view of two shipping containers of FIG. 14 glued together.

The shipping container 10 holds, secures, and substantially encloses the product 54 for shipping. The first and third sections 22*a*, 22*c* are generally flat because no flaps are glued thereto and therefore provide suitable surfaces for gluing two adjacent shipping containers 10 together, as shown in FIG. 15. The first and third sections 22*a*, 22*c* are also, in the illustrated construction, elongated. The dimensions of the shipping container 10 are defined by a width X, a length Y, and a height Z (FIG. 14). These dimensions (the width X, the length Y, and the height Z) correspond to the dimensions of the blank 14 (the width E, the length C, and the height D), as described above. For example, the width X, the length Y, and the height Z may be equal to the width E, the length C, and the height D. In some constructions, the width X, the length Y, and the height Z may include a slight addition to account for material thickness on all sides (e.g., by adding 0.0625 in. to 1.0 in. to the corresponding dimension of the blank 14). Thus, the values of the width X, the length Y, and the height Z need not be described again as reference is made to the values, and ranges of values, discussed above. Similarly, as described above, the shipping container 10 may also be scaled, skewed, or disproportionately enlarged or reduced to any other size. For example, the dimensions of the first and third sections 22*a*, 22*c* are defined by the length Y and the height Z. In the illustrated construction, the length Y is about 10 in. and the height Z is about 8 or 9 in., but may have other elongated dimensions in other constructions. In the context of the length Y and the height Z, the term "about" means plus or minus half inch. (e.g. the length Y is 10±0.5 in. and the height Z is 8 or 9±0.5 in. in FIG. 1). Using the length Y as a reference for the overall dimensions, the width X is 35%-55% of the length Y, and the height Z is 75%-95% of the length Y. However, in other constructions, the overall dimensions may have any value having any relative proportion. The features of the invention (such as the viewing hole 82, the tear portion 36, the handle 40, the display portion 38, etc.) do not depend on the specific dimensions, or can be similarly scaled or skewed to corresponding dimensions, and can thus be adapted for any overall shape and size.

Thus, the first and third sections 22*a*, 22*c* form tall side walls in the shipping configuration, and in the display configuration which will be described below, to aid in supporting the product 54 within. The product 54 may be formed of elongated flexible material or packaging that is less stable on its own without the aid of a support structure. In other constructions, the product 54 need not be elongated. Generally, the dimensions of the shipping container 10 correspond closely with the dimensions of the product 54, or, more specifically, a plurality (such as a stack) of the product 54. For example, the product 54 may include packaged food, such as cheese, meats, crackers, nuts, etc. In other constructions, the product 54 may include non-edible products, such as printed media (e.g., brochures, pamphlets, books, maps, etc.), paper products (e.g., envelopes, stationery, etc.), or any other stackable or standing products.

Figure 16:
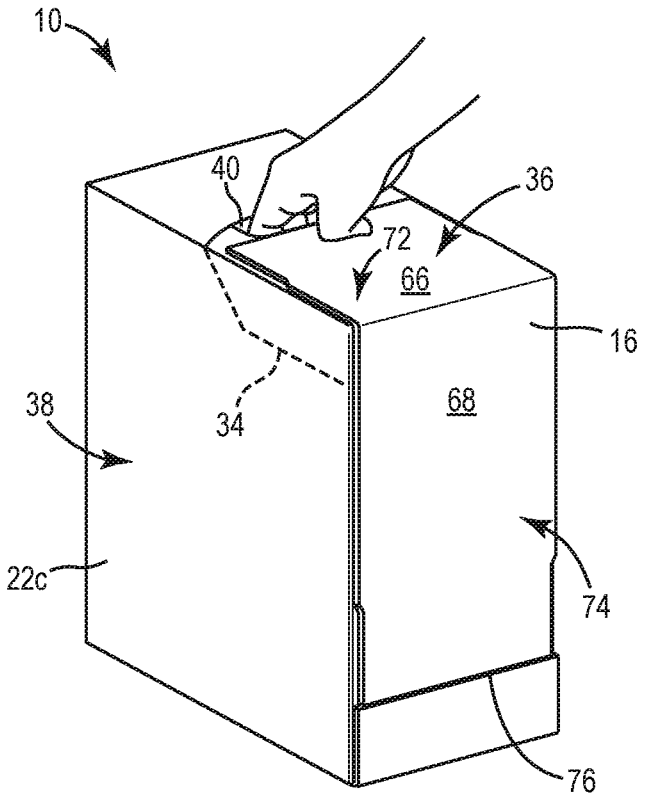
FIGS. 16-18 are perspective views illustrating conversion of the shipping container of FIG. 14 being converted into a display container.
Figure 17:
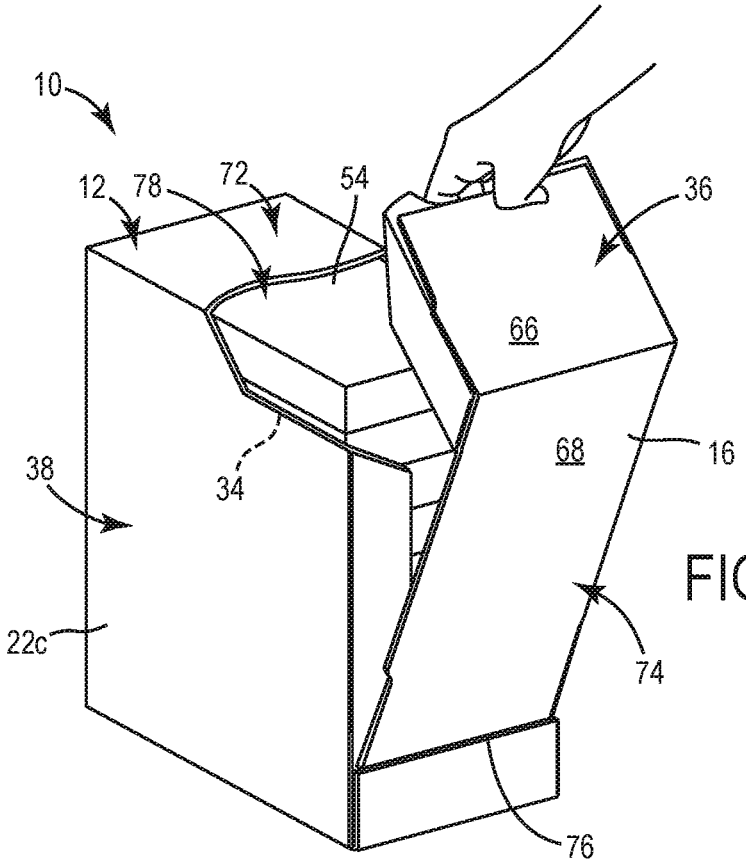
Figure 18:
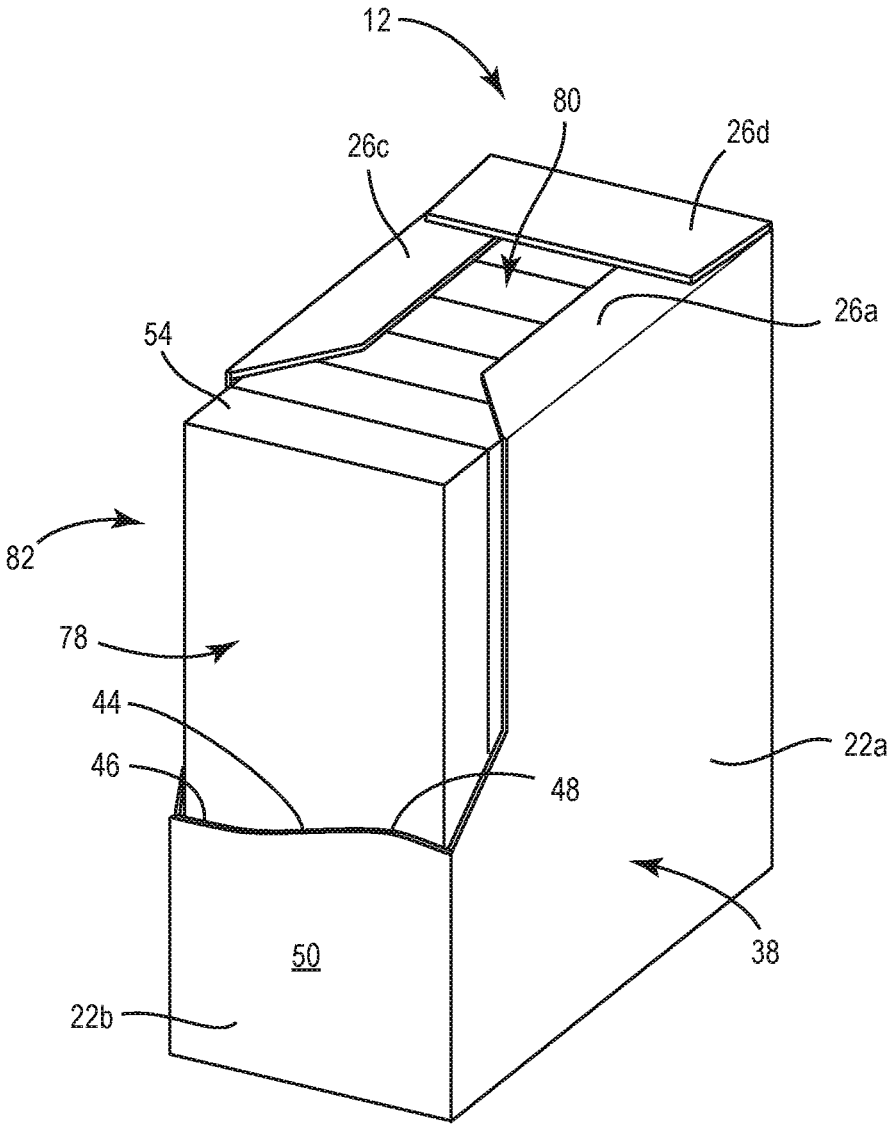

FIGS. 16-18 illustrate conversion of the shipping container 10 to the display container 12. For example, when the shipping container 10 reaches a retailer, the retailer may convert the shipping container 10 to the display container 12 and place the display container 12 directly on a shelf viewed by consumers without having to remove the product 54 from the chamber 32 for stocking. As shown in FIG. 16, a user inserts one or more fingers into the handle 40 and applies a pull force (e.g., in a direction generally parallel to the first side 72) on the tear portion 36 to separate, detach, and remove the tear portion 36 and the tear support piece 16 along the tear lines 34 in a removal stroke (FIG. 17). During the removal stroke, the tear support piece 16 provides rigidity and strength to the tear portion 36 to discourage tearing of the material 18 that is not within the tear lines 34, thereby encouraging clean tearing along the tear lines 34. The tear support piece 16, being disposed on two transverse sides 72, 74 of the shipping container 10, also facilitates transfer of the pulling force as the tear transitions from the first side 72 to the second side 74. The user is not required to pull in a second lateral direction during the removal stroke because the tear support piece 16 is not fully coupled along a distal edge 76 (FIGS. 11-14) to one of the upper flaps 26*a*-26*d* forming the sixth wall, e.g., to the fourth upper flap 26*d* in the first and second constructions of the blank 14 or to the first and third upper flaps 26*a*, 26*c* in the third construction of the blank 14. Thus, the distal edge 76 is effectively pre-torn. As such, the tear support piece 16 can be torn cleanly from the first and second sides 72, 74 in a generally single motion. The tear support piece 16 may be disposed adjacent the handle 40, which also facilitates clean tearing of the tear portion 36 throughout the removal stroke. The angle of the tear lines 34, and the tear lines 34 extending continuously away from the handle 40 (i.e., continuously increasing in distance laterally away from the handle 40 in the direction A), may also facilitate clean tearing of the tear portion 36 throughout the removal stroke. Furthermore, the user may only need to use one hand in order to remove the tear portion 36 and the tear support piece 16 from the display portion 38 such that the removal of the tear portion 36 is conducted in a single removal stroke. Therefore, the display portion 38 is convertible into (e.g. becomes) the display container 12 by removal of the tear portion 36 and the tear support piece 16 coupled to the tear portion 36 from the display portion 38.

FIG. 18 illustrates the display container 12 displaying the product 54. Removal of the tear portion 36 creates a top opening 80 on the second side 74 connected to a display opening 78 on the first side 72 all the way to the fourth elongated side 44. The convex edge 48 provides for additional material being left behind on the display portion 38 when the tear portion 36 is removed, in contrast with a straight horizontal edge. Thus, the convex edge 48 defines an indicia region 50 in which logos, images, brands, text, marks, and other indicia can be displayed. A length F, shown in FIGS. 1,2, and 4, determines the height of the region 50 (e.g. the height from the convex edge 48 to the fold lines 30 between the first side 72 and a side of the displaying container 12 including the lower flaps 24*a*-24*d*). In FIG. 1, the height F is about 3 in. In FIGS. 2 and 4, the height F is about 2.8 in. In the context of the height F, "about" means plus or minus 1 inch. The indicia region 50 is featured adjacent the product 54 for providing information to the consumer about the product 54, for example, or for other desired purposes.

The sections 26*a*, 26*c*, which provide the side walls of the display container 12, frictionally engage side edges of the product 54. Furthermore, the upper flaps 26*a*, 26*c*, 26*d* provide a partial top wall to frictionally engage top edges of the product 54. This frictional engagement between the display container 12 and the product 54 aids in maintaining product orientation and inhibits falling forward of the product 54.

Furthermore, because there are no flaps in a width direction X extending between the first and third sections 22*a*, 22*c*, the overall width of the shipping container 10 is reduced thereby reducing consumption of shelf space when the display container 12 is displayed.

Figure 19:
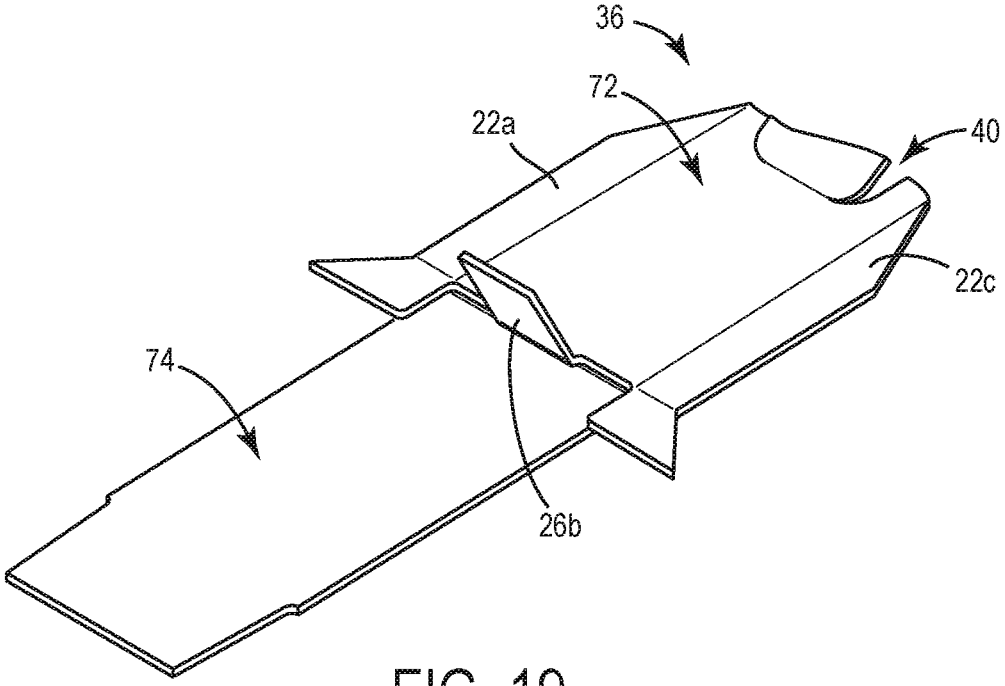
FIG. 19 is a perspective view of the tear portion removed from the display container of FIG. 18 including the tear support piece shown in FIG. 11.
Figure 20:
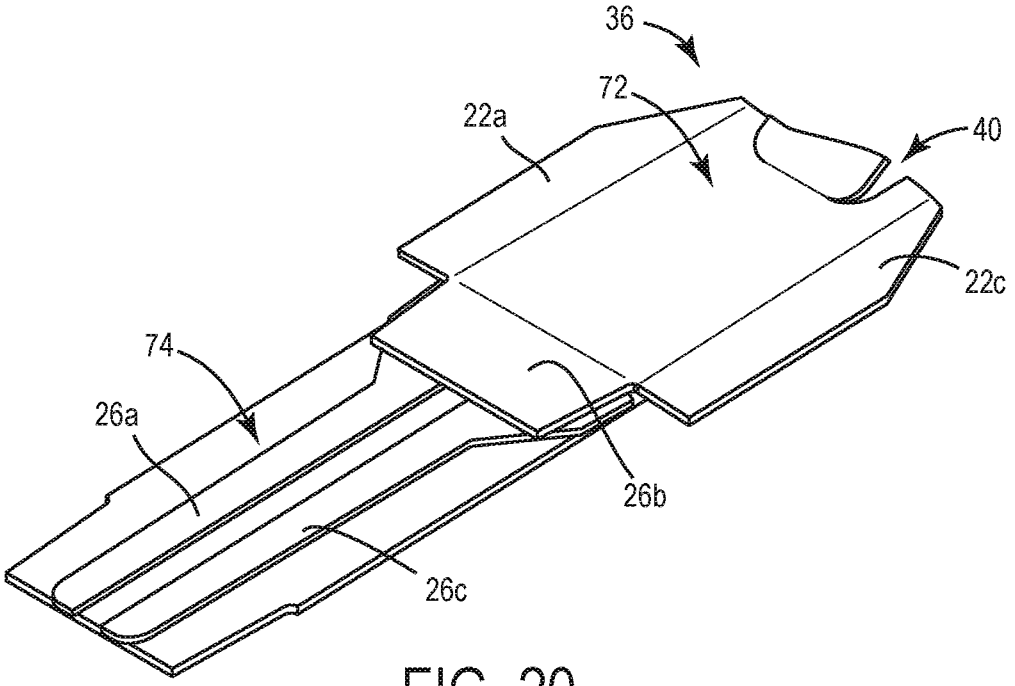
FIG. 20 is a perspective view of the tear portion removed from the display container of FIG. 18 including the tear support piece shown in FIG. 12.

FIGS. 19 and 20 illustrate the tear portion 36 removed from the display portion 38 after conversion from the shipping container 10 to the display container 12. The tear portion 36 in FIG. 19 includes the tear support piece 16, the upper flap 26*b*, the first side 72 up to the fourth elongated side 44 of the handle 40, a portion of the first section 22*a* adjacent the first side 72, and a portion of the third section 22*c* adjacent the first side 72 and opposite the portion of the first section 22*a*. The tear portion 36 in FIG. 20 includes the tear support piece 16, the upper flap 26*b*, a portion of the upper flap 26*a*, a portion of the upper flap 26*c*, the first side 72 up to the fourth elongated side 44 of the handle 40, a portion of the first section 22*a* adjacent the first side 72, and a portion of the third section 22*c* adjacent the first side 72 and opposite the portion of the first section 22*a*. Notably, the handle 40 is included in the tear portion 36 removed from the display portion 38, where the handle 40 defined a portion of the border between the display portion 38 and the tear portion 36 on the first side 72, before the tear portion 36 is removed from the display portion 38.

Figure 21:
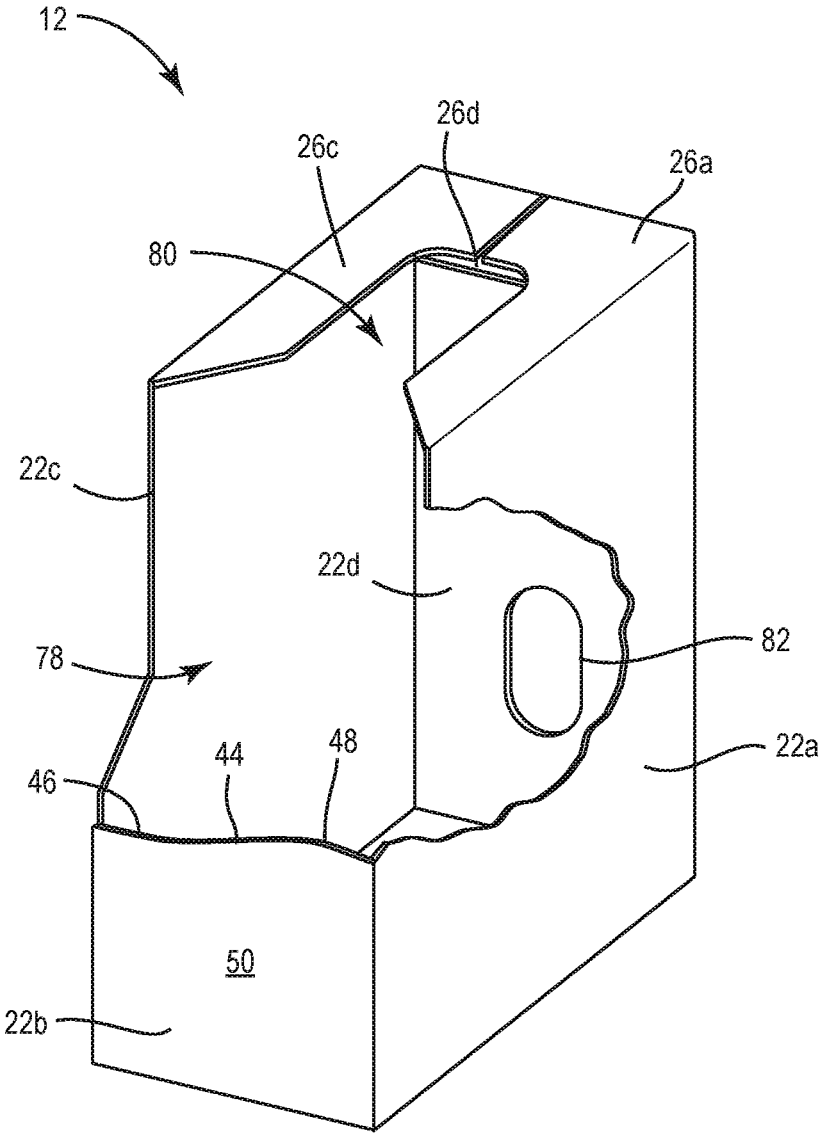
FIG. 21 is another perspective view illustrating the display container embodying the invention.

Referring to FIG. 21, the viewing hole 82 is located on the display container 12 when the tear portion 36 is removed from the display portion 38 (i.e., the viewing hole is located on the display portion 38). In the illustrated construction, the viewing hole is located opposite the first side 72 (e.g. the side including the second section 22*b* having the handle 40) of the tear portion 36; therefore, the viewing hole 82 is opposite one of the sides that is largely removed and adjacent another one of the sides that is largely removed. The viewing hole 82 may be seen once some or all of the product has been removed from the display container 12. A retailer or consumer may use the viewing hole 82 to locate a shipping container 10 located behind the display container 12. For example, when the display container 12 is empty or partially empty, a user may look through the viewing hole 82 to determine whether another shipping container 10 is stocked behind the display container 12 or whether additional containers need to be brought out to the retail area.

Thus, the disclosure provides, among other things, a convertible shipping container 10 and a method of displaying a product 54. The shipping container 10 reduces the overall amount of material required, provides a more efficient design, facilitates cleaner tearing, provides flat sides so adjacent shipping containers 10 can be glued together, reduces overall width of the display container 12 by eliminating flaps in the display width direction thereby reducing consumption of shelf space, and allows the user to view behind the display container 12. Various features and advantages of the invention are set forth in the following claims.

What is claimed is:

1. A shipping container convertible to a display container, the shipping container comprising:

a case generally defining a plurality of sides, the case being divisible along a single tear line into a display portion and a tear portion, wherein the display portion is made up of at least a portion of one of the plurality of sides, wherein the tear line extends across at least four of the plurality of sides, wherein the tear portion is made up of at least a portion of four of the plurality of sides; and a tear support piece couplable to and overlapping only two of the plurality of sides, wherein the tear support piece includes only a single fold line defining no more than two sections;

wherein the tear portion is configured to provide a first layer of material and the tear support piece is configured to provide a second layer of material increasing a thickness of the shipping container to add rigidity to the tear portion for facilitating divisibility of the tear portion and the display portion, the thickness defined between an interior of the shipping container and an exterior of the shipping container;

wherein the display portion is convertible into the display container by removal of the tear portion and the tear support piece.

2. A shipping container convertible to a display container, the shipping container comprising:

a case generally including a plurality of sides, the case being divisible along tear lines into a display portion and a tear portion, wherein the display portion defines at least one of the plurality of sides, wherein the tear portion at least partially defines at least two of the plurality of sides, wherein at least three of the plurality of sides includes tear lines, wherein at least two of the plurality of sides of the tear portion are adjacent; and a tear support piece couplable to [the tear portion and adapted to be couplable to the] at least two of the plurality of sides that are adjacent, wherein the tear support piece includes no more than a single fold line defining two sections, each section couplable to a side and the tear support piece overlapping only two of the plurality of sides;

wherein the display portion is convertible into the display container by removal of the tear portion and the tear support piece.

3. The shipping container of claim 2, wherein the tear support piece overlaps the tear portion to provide a second layer of material.

4. The shipping container of claim 2, wherein the tear portion defines at least 30% of at least one but no more than two of the plurality of sides and defines a smaller percentage of two others of the plurality of sides.

5. A shipping container convertible to a display container, the shipping container comprising:

a case generally defining a plurality of sides, the plurality of sides [substantially] enclosing a chamber on all sides for containing a product, the case being divisible along a single tear line into a display portion and a tear portion, the single tear line extending across at least three of the plurality of sides; and a tear support piece couplable to the tear portion, wherein the tear portion is configured to provide a first layer of material and the tear support piece is configured to provide a second layer of material increasing a thickness of the shipping container, the thickness defined between an interior of the chamber to an exterior of the shipping container;

wherein the display portion is convertible into the display container by removal of the tear portion and the tear support piece.

6. The shipping container of claim 5, wherein the tear portion includes a first substantially planar surface and first edges defined at least partially along a perimeter of the first substantially planar surface, wherein the tear support piece includes a second substantially planar surface and second edges defined at least partially along a perimeter of the second substantially planar surface, and wherein the first substantially planar surface is configured to be couplable to the second substantially planar surface to increase the thickness of the shipping container.

7. A shipping container convertible to a display container, the shipping container comprising:

a case including a plurality of sides, the case being divisible along at least one tear line into a display portion and a tear portion, wherein the display portion is defined by at least a portion of one of the plurality of sides, and wherein the tear portion is defined by at least a portion of three of the plurality of sides; and a tear support piece couplable to and overlapping only two of the plurality of sides;

wherein the tear support piece is adapted to add rigidity to the tear portion to facilitate divisibility of the tear portion and the display portion;

wherein the display portion is convertible into the display container by removal of the tear portion and the tear support piece.

8. The shipping container of claim 7, wherein the tear portion defines at least 30% of at least one but no more than two of the plurality of sides and defines a smaller percentage of two others of the plurality of sides.

* * * * *